US007454163B2

(12) United States Patent
Kasahara et al.

(10) Patent No.: US 7,454,163 B2
(45) Date of Patent: Nov. 18, 2008

(54) BOOKBINDING SYSTEM

(75) Inventors: Seitaro Kasahara, Tokyo (JP); Mitsuo Motohashi, Tokyo (JP); Masahiko Kamei, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 354 days.

(21) Appl. No.: 10/704,007

(22) Filed: Nov. 6, 2003

(65) Prior Publication Data

US 2004/0098665 A1 May 20, 2004

(30) Foreign Application Priority Data

Nov. 8, 2002 (JP) ..... 2002-325261

(51) Int. Cl.
*G03G 15/00* (2006.01)

(52) U.S. Cl. ..... 399/408; 399/407; 270/52.02; 412/11

(58) Field of Classification Search ..... 412/3, 412/4, 5, 8, 11, 17, 18, 19; 270/52.02, 52.03; 399/407, 408, 409, 410
See application file for complete search history.

(56) References Cited

U.S. PATENT DOCUMENTS 4,487,430 A * 12/1984 Bernardin ..... 281/29
4,505,629 A * 3/1985 Lynch ..... 412/5
5,465,213 A * 11/1995 Ross ..... 700/117
5,735,659 A * 4/1998 Kosasa et al. ..... 412/9
6,206,358 B1 * 3/2001 Yamaguchi et al. ..... 270/52.02
6,460,843 B1 * 10/2002 Dim et al. ..... 270/58.07
6,857,796 B2 * 2/2005 Hatayama ..... 400/61
6,923,436 B2 * 8/2005 Figueras Payas ..... 270/1.01

FOREIGN PATENT DOCUMENTS

JP 02-303893 B2 12/1990
JP 03-151286 B2 6/1991
JP 03-151287 B2 6/1991
JP 03-151290 B2 6/1991
JP 03-151292 B2 6/1991
JP 03-151571 B2 6/1991
JP 08-085276 B2 4/1996
JP 2752738 B2 2/1998

(Continued)

*Primary Examiner*—Ren Yan
(74) *Attorney, Agent, or Firm*—Frishauf, Holtz, Goodman & Chick, P.C.

(57) ABSTRACT

There is provided a bookbinding system which can carry out a process from image formation to glued bookbinding in-line. The bookbinding system comprises a book content data input section 101 to which book content data regarding a content of a book is entered, a cover sheet data input section 101 to which cover sheet data regarding a cover sheet display is entered, a book content image formation section 105 which forms images on recording sheets based on the book content data entered from the book content data input section, a cover sheet display image formation section 105 which forms an image on a case cover based on the cover sheet data entered from the cover sheet data input section, back gluing means 203 for back-gluing the recording sheets on which the images have been formed, and casing means 204 for casing the recording sheets back-glued by the back gluing means with a case cover to bond the sheets.

39 Claims, 23 Drawing Sheets

FOREIGN PATENT DOCUMENTS

| | | | |
|---|---|---|---|
| JP | 2752739 | B2 | 2/1998 |
| JP | 2752740 | B2 | 2/1998 |
| JP | 10-151734 | A | 6/1998 |
| JP | 2845999 | B2 | 10/1998 |
| JP | 11-139037 | A | 5/1999 |
| JP | 2944688 | B2 | 6/1999 |
| JP | 11-180068 | A | 7/1999 |
| JP | 2000-184154 | | 6/2000 |
| JP | 3133747 | B2 | 11/2000 |
| JP | 3146335 | B2 | 2/2001 |

* cited by examiner

BOOKBINDING SYSTEM

BACKGROUND OF THE INVENTION

1. Field of the Invention

The present invention relates to a bookbinding system for binding books by use of book content data and cover data.

2. Description of the Prior Art

In order to give a sense of high quality and the durability to a book, a cover (case cover) which is made of a material different from sheets used to write the contents of the book is attached to the sheets. There are various kinds of known methods for this, and for example, wire stitching and perfect binding have often been used. However, in these methods of the wire stitching and the like, it is difficult to put a small edition of books into mechanization for bookbinding, and a cost for the bookbinding increases in a certain case. Accordingly, as a method to which much attention has recently been paid, a so-called gluing bookbinding is present. In this method, a cover is attached with a glue to sheets on which contents are written and which are folded in the order of pages. That is to say, a plurality of sheets containing the contents of the book are first stacked in the order of pages so that the sheets are not scattered. Then, a cover is prepared and glued to the bound book in a spine portion to complete the book. Heretofore, for the above bookbinding, there-have been proposed apparatuses and methods for forming images on predetermined sheets by use of book content data in which the contents of the book are recorded and cover data regarding a cover, and then binding the sheets containing the printed contents and the cover by the gluing.

For example, Japanese Patent Nos. 2752738, 2752739 and 2752740 disclose an apparatus for bookbinding in which a cover is bound to a bundle of transfer sheets on which images are formed by an image forming apparatus such as a copying unit. In addition to the above-described apparatus, Japanese Patent No. 2845999 discloses an apparatus in which images are formed providing a margin for a gluing part. Furthermore, Japanese Patent No. 2944688 discloses an apparatus comprising recording means for forming images on recording sheets while providing a margin for a gluing part as well as a bookbinding mechanism for binding the recording sheets.

Japanese Patent No. 3133747 discloses a bookbinding apparatus for avoiding a binding miss due to a malfunction of a guide plate for guiding objects to be bound during a gluing bookbinding step.

Japanese Patent No. 3146335 discloses a bookbinding apparatus for performing bookbinding by use of a binding tape on which printing is also possible.

Japanese Patent Application Laid-open No. 151734/1998 discloses a printing apparatus for case bookbinding after a spine portion has been processed by printing the spine portion in accordance with the thickness of a bound book including formed images.

Japanese Patent Application Laid-open 139037/1999 discloses an apparatus and a method for gluing and case bookbinding in which quires and a cover are glued and folded into two.

Japanese Patent Application Laid-open 180068/1999 discloses a method in which a case bound book is prepared in a size larger than that of a book to be finally completed, and three sides of the book are then cut off for finishing. For a spine of the book, a flexible material is used.

Japanese Patent Application Laid-open 2000-184154 discloses an apparatus which detects the thickness of a recording medium on which images are formed and which estimates the thickness of a spine in accordance with the detected thickness.

In the conventional bookbinding systems, however, each step of image formation for a text body, printing on a cover and case bookbinding is based on an off-line system. For example, the cover is prepared by offset print, and the images for the text body are formed by a monochromatic printer. Thus, the system is performed by the off-line until the case bookbinding. This is performed by on-demand in a unit of one or two days, but it is not due to on-demand in a unit of one or two minutes. Therefore, the conventional bookbinding apparatus has a serious problem that it is difficult to make a book on the spot at a store wherein the apparatus is installed.

SUMMARY OF THE INVENTION

The present invention made with the foregoing situation in mind offers a bookbinding system apparatus suited as a book on-demand system which can carry out a process from image formation to glued case bookbinding.

In order to solve the above problems, a first aspect of the present invention is directed to a bookbinding system comprising a book content data input section to which book content data regarding a content of a book is entered; a cover sheet data input section to which cover sheet data regarding a cover sheet display is entered; a book content image formation section which forms images on recording sheets based on the book content data entered from the book content data input section; a cover sheet display image formation section which forms an image on a case cover based on the cover sheet data entered from the cover sheet data input section; back gluing means for back-gluing the recording sheets on which the images have been formed; and casing means for casing the recording sheets back-glued by the back gluing means with a case cover to bond the sheets.

A second aspect of the present invention is directed to the bookbinding system according to the first aspect, comprising recording sheet housing means for housing the recording sheets; recording sheet feeding means for feeding the recording sheets to the book content image formation section; case cover housing means for housing the case cover; case cover feeding means for feeding the case cover to the cover sheet display image formation section; recording sheet conveying means for conveying the recording sheets on which the images have been formed; collection means for collecting the recording sheets on which the images have been formed and which have been conveyed by the recording sheet conveying means; alignment means for aligning the recording sheets collected by the collection means before the back gluing; and case cover conveying means for conveying the case cover on which the image has been formed to the casing means.

In the conventional on-demand system, each one of the steps such as text image formation, cover sheet printing, and case bookbinding has been an off-line system. Thus, a big problem has been inherent, i.e., a difficulty of installing the book on-demand system at a storefront to print/bind a book there. According to the first and second aspects of the present invention, it is possible to carry out the process from image formation on both of the text and the cover sheet to completion of a case bound book in-line.

According to the present invention, the book content data regarding the book content and the cover sheet data regarding the cover sheet display are used.

The book content data contains at least text data. Further, book item data can be contained in the book content data. The book item data is constituted of bits of information such as a book title, a publishing company, an author, author introduction, a publishing house, a printing house, a bookbinding house, a price, and a letter of introduction, and one, two or more bits of such information are held as data. Content identification information can be contained as data in the book content data. The content identification information data can comprise a book code commonly used in a publishing world, bookbinding system's own identification number of the invention, etc., and the book item data can also be used as identification information data.

According to the present invention, as described above, the bookbinding system comprises the book content data input section to which the book content data is entered, and the cover sheet data input section to which the cover sheet data is entered. These data input sections can representatively comprise network communication means as described later, and they can be constituted so that parts or all of the book content data and the cover sheet are stored in the server connected to the network, and the data can be entered through the network.

However, according to the present invention, the necessary data only need to be entered. For example, a portable storage medium may be used to enter the data. The book content data input section and the cover sheet data input section may be disposed individually, and these sections may have a common input section. All of the book content data and the cover sheet data may be entered through the same input path, or parts of the data may be entered through a plurality of input paths, and the data may be added to construct the entire data.

Additionally, according to the present invention, the bookbinding system comprises the book content image formation section which forms images on recording sheets based on the book content data, and the cover sheet display image formation section which forms an image on a case cover based on the cover sheet display data. The image formation section only needs to be capable of forming an image on a sheet by using data irrespective of a constitution. Generally, the image formation section properly processes a signal for image data (data of picture, character or the like), forms an image by an electrophotographic process based on the data, and comprises a photosensitive drum which forms a latent image based on the image data.

The book content image formation section and the cover sheet display image formation section can be constituted of a common image formation section as described later, or individually prepared.

According to the second aspect of the present invention, the recording sheets and the case cover on which the images are formed can be housed in the recording sheet housing means and the case cover housing means. These housing means can be constituted to laminate the recording sheets and the case covers to house them. For housing, the recording sheets or the case cover may be housed in a cassette or mounted on a manual feeding base.

The recording sheets and the case cover are fed by the housing means to the image formation sections disposed for image formation. The feeding can be carried out by the operations of the recording sheet feeding means and the case cover feeding means.

The feeding means takes out a sheet housed in the housing means to convey it. For example, the feeding means can be constituted in a manner that a plurality of feed rollers are arranged from the housing means along a feeding path, and the recording sheets or the case cover is transferred by the rollers.

The recording sheets and the case cover on which the images have been formed are conveyed to the casing means or the like by the conveying means. As in the case of the feeding means, the conveying means can be constituted in a manner that a plurality of rollers are arranged from the image formation section along a conveying path, and the recording sheets or the case cover is transferred by the rollers.

According to the present invention, the bookbinding system comprises the back gluing means for back-gluing the recording sheets on which the images have been formed. The back gluing means only needs to be capable of sticking a glue to the back of the recording sheet, and the invention is not limited to any particular structure. For example, means which comprises a discharge section for using a glue discharge nozzle to discharge a glue from a glue housing section to the back of the recording sheet, means which comprises a coating member installed in the glue housing section, rotates the coating member to stick a glue, and brings the coating member into contact with the recording sheet to coat the glue, or the like can be used.

For the back-gluing, the recording sheets must be collected and aligned. These can be carried out by the collection means for collecting the recording sheets conveyed by the recording sheet conveying means, and the alignment means for aligning the recording sheets collected by the collection means.

The collection means laminates and collects a plurality of recording sheets. For example, it can comprise a stopper on which the recording sheets conveyed by the conveying means are abutted, and a stacker which receives the recording sheets abutted on the stopper to stop.

The alignment means aligns outer peripheral edges of the collected recording sheets. For example, the alignment member abutted on the outer sides of the recording sheets is slid by proper driving means to adjust positional shifting of the recording sheets and align them. Alternatively, the collected recording sheets are moved, and abutted on the positioning member to be aligned.

Before/after the back-gluing, or after casing, the recording sheets or the case cover can be cut to adjust a size of the case cover, e.g., size adjustment of the laminated recording sheets, cutting of the folded recording sheets or the like. The cutting means can comprise a proper cutter, a positioning device for positioning the cutter, a driving device for operating the cutter, etc.

According to the present invention, the bookbinding system comprises the casing means for casing the back-glued recording sheets by the case cover to bond them. The casing means only needs to carry out the above processing, and its constitution is not limited to any particular constitution according to the invention. For example, an inner surface of a portion equivalent to the spine of the case cover is pressed to the back-glued portion of the recording sheets by a pressing plate or the like to be bonded by a back glue, the front cover sheet portion and the back cover sheet portion of the case cover are folded to the recording sheet surface side by operating a folding member or the like, and receive pressure from the outer surface side of the case cover by a pressurizing plate or the like, whereby the casing operation can be carried out.

A third aspect of the present invention is directed to the bookbinding system according to the first or second aspect, wherein the book content input section and the cover sheet display input section comprise network communication means, and parts or all of the book content data and the cover sheet data are stored in a sever connected to the network, and transmitted to the book content input section and the cover sheet display input section through the network.

According to the third aspect, bookbinding work can be carried out quickly by targeting many kinds of books without any geographical problems. The book content can be easily managed by the server and, in the binding system as a terminal, a request of data transmission is made to enable easy acquisition of a desired book. The server may be constituted of one computer, or a plurality of severs such as a management server and a data server.

A fourth aspect of the present invention is directed to the bookbinding system according to any one of the first to third aspects, wherein the book content image formation section and the cover sheet display image formation section are constituted of a common image formation section.

According the fourth aspect, since the common image formation section is used for image formation of the book content and image formation of the cover sheet display, the device constitution can be simplified to be advantageous in costs and installation space. For example, it is possible to provide a system which can form images of the book content and the cover sheet by one color printer.

A fifth aspect of the present invention is directed to the bookbinding system according to any one of the first to third aspects, wherein one of the book content image formation section and the cover sheet display image formation section is constituted of a color printer, and the other is constituted of a monochromatic printer.

A color image may be printed on the cover sheet while a monochromatic image is printed on the book text. In such a case, according to the fifth aspect, for example, images can be formed on the book text of many pages by a monochromatic printer which can carry out high-speed processing, and an image can be formed on the cover sheet by a color printer which is relatively low in speed but capable of color printing. When necessary, the color printer and the monochromatic printer can be separately used. The recording sheet is, for example, plain paper called gold bur sheet, while thick coat paper may be used for the case cover. Thus, control conditions (transfer current, separation current etc.) may be different during image formation. These can be individually and easily controlled by using different image forming devices, e.g., the color printer and the monochromatic printer.

A sixth aspect of the present invention is directed to the bookbinding system according to any one of the first to fifth aspects, wherein a part of a cover sheet display is printed or an image is formed on the case cover before the case cover is housed in the case cover housing means, and the cover sheet display image formation section forms an image of the other cover sheet display superposedly on the case cover.

For the conventional case cover, either a dedicated design or a general-purpose design is used. In the case of the book on-demand system, there are problems to be solved, i.e., one-to-one management with the book content data is burdensome for the dedicated design, and it is impossible to know what a book is about for the general-purpose design. Additionally, in the case of the general-purpose design of the conventional case cover, since no ordinary information similar to that of a book is printed, for example, there are no barcodes, there is a problem of impossible charging at a cash register.

In the case of the dedicated design of the conventional case cover, because of printing by a lot unit, there is a problem of impossible inclusion of intrinsic information in one sheet.

A message card has conventionally been attached when a book is presented as a gift. However, the card may be lost with that passage of time to make it impossible to understand the message.

According to the sixth aspect, it is possible to carry out the process from formation of an image on the text by a printer, formation of an image on the case cover by superposing a necessary display on an offset print made beforehand by a general-purpose design to completion of a case bond book in-line. Thus, a display intrinsic to the book can be made on the case cover of the general-purpose design to solve the aforementioned problem.

A seventh aspect of the present invention is directed to the bookbinding system according to the sixth aspect, wherein the cover sheet display made beforehand on the case cover is printed by color, or it is a color print, and the superposed image is a monochromatic print.

According to the seventh aspect, it is possible to provide a system which can ink-print intrinsic information by the monochromatic printer while the case cover color-printed by a general-purpose design is used as a base.

An eighth aspect of the present invention is directed to the bookbinding system according to any one of the first to seventh aspects, wherein the cover sheet display contains at least one of a book title, an author's name, an publishing house, a price, a bookstore's name, and barcode information.

According to the eighth aspect, necessary information among a book title, an author's name, a publishing place, a price, a bookstore's name, and barcode information can be printed superposedly on the case cover. Preferably, a barcode having price information is made essential in order to carry out charging at the cash register as in the case of an ordinary book.

An ninth aspect of the present invention is directed to the bookbinding system according to any one of the first to eighth aspects, wherein the cover sheet display contains intrinsic information of a book purchaser.

According to the ninth aspect, the general-purpose design and the superposed print are further advanced to enable printing of not only necessary information but also intrinsic information on the case cover. Thus, for example, a purchaser's own book can be completed.

A tenth aspect of the present invention is directed to the bookbinding system according to the ninth aspect, wherein the intrinsic information is at least one of an address of the book purchaser, a name, a message by the purchaser, and a purchase date.

According to the tenth aspect, not only a gift receiver's name and a date but also a message to be sent can be printed as intrinsic information on the cover sheet.

An eleventh aspect of the present invention is directed to the bookbinding system according to any one of the first to tenth aspects, wherein the case cover has three areas, i.e., a front cover sheet area, a spine area and a back cover sheet area, and cover sheet image formation positioning means is provided to position an image to be formed in each area based on a center reference or one-side abutment reference and by considering a thickness of the spine area when an image is formed on the case cover.

According to the eleventh aspect, a thickness of the spine, and areas of the front cover sheet and the back cover sheet are decided in accordance with the amount of the text (thickness of recording sheets) to enable image positioning. It is not necessary to prepare case covers matched in size with different kinds of books, and the general-purpose case cover can be used for various kinds of books.

A twelfth aspect of the present invention is directed to the bookbinding system according to the eleventh aspect, further comprising recording sheet thickness registration means for registering a thickness of one recording sheet for each kind of paper; counting means for counting the number of recording sheets on which images are formed to bound a book; and spine area thickness calculation means for calculating a thickness necessary for the spine area based on the thickness data registered by the registration means and data of the number of sheets counted by the counting means.

To provide the on-demand color printing of the case cover and the general-purpose superposed printing, the thickness of the spine and the positioning of the sheet size are problems. As the conventional spine thickness deciding means, there are a method for measuring a thickness of the sheet, and a method for setting a thickness of the sheet. However, there are problems, i.e., the device is large in the former case, and thickness must be set again each time a paper kind is changed.

According to the twelfth aspect, it is possible to calculate a thickness of the entire recording sheets which is equivalent to the thickness of the spine based on the registered thickness of the recording sheet and the number of recording sheets on which the images have been formed.

A thirteenth aspect of the present invention is directed to a bookbinding system comprising a book content data input section to which book content data regarding a content of a book is entered; a book content image formation section which forms images on recording sheets based on the book content data entered from the book content data input section; case cover housing means for housing a case cover on which cover sheet display has been printed or an image has been formed; back gluing means for back-gluing the recording sheets on which the images have been formed; and casing means for casing the recording sheets back-glued by the back gluing means with a case cover to bond the sheets.

A fourteenth aspect of the present invention is directed to the bookbinding system according to the thirteenth aspect, further comprising recording sheet housing means for housing the recording sheets; recording sheet feeding means for feeding the recording sheets to the book content image formation section; recording sheet conveying means for conveying the recording sheets on which the images have been formed; collection means for collecting the recording sheets on which the image has been formed and which have been conveyed by the recording sheet conveying means; alignment means for aligning the recording sheets collected by the collection means; and case cover feeding conveying means for feeding and conveying the case cover housed in the case cover housing means to the casing means.

Conventionally, there has been a problem of impossible passage of a case cover on which a predetermined print has been made or printing has been carried out, or a case cover of a predetermined thickness. According to the thirteenth and fourteenth aspects of the present invention, the case cover can be directly conveyed from the case cover housing means to the casing means side without passage through the image formation section. The case size detection means is disposed in the case cover housing means.

A fifteenth aspect of the present invention is directed to the bookbinding system according to any one of the first to fourteenth aspects, wherein case cover presence detection means is disposed in the case cover housing means.

A sixteenth aspect of the present invention is directed to the bookbinding system according to any one of the first to fifteenth aspects, wherein case cover size detection means is disposed in the case cover housing means.

A seventeenth aspect of the present invention is directed to the bookbinding system according to the fifteenth aspect, wherein starting of image formation of the book content data is permitted irrespective of a presence detection result by the case cover presence detection means.

An eighteenth aspect of the present invention is directed to the bookbinding system according to the sixteenth aspect, wherein stating of image formation of the book content data is permitted irrespective of a size detection result by the case cover side detection means.

Conventionally, there has been a problem of impossible permission of starting image formation of the book content data if the case cover presence detection means disposed in the case cover housing means detects nonpresence of case covers or if the case cover size detection means detects a size other than a predetermined size. According to the seventeenth and eighteenth aspects, irrespective of the result of the detection, the image formation of the book content data can be started to enable quick processing. Moreover, in order to deal with the case of starting image formations of the text (book content data) and the case cover by different image formation sections, the starting of the image formation of the book content data can be permitted even if no case covers are set beforehand in the cover housing means. Additionally, since the image formation can be started even if a case cover of an improper size is set in the case cover housing means, the starting of the image formation of the book content data can be permitted.

A nineteenth aspect of the present invention is directed to the bookbinding system according to any one of the fifteenth to eighteenth aspects, wherein the feeding of the case cover from the case cover housing means is stopped if nonpresence of case covers is detected or a size other than a predetermined size is detected.

According to the nineteenth aspect, when nonpresence of case covers or a size other than the predetermined size is detected, and the image formation of the book content data is started, the feeding of the case cover is stopped in the state in which no proper case covers have been housed.

A twentieth aspect of the present invention is directed to the bookbinding system according to the nineteenth aspect, wherein the stop of the feeding by the detection of the nonpresence of case covers is released if the case cover presence detection means detects presence of a case cover after image formation based on the book content data is started in a detection state of no case covers.

Conventionally, there has been a difficulty of validating a case cover in the midway even if the case cover presence detection means disposed in the case cover housing means detects presence of the case cover after the permission of the starting of the image formation. According to the twentieth aspect, if presence of a case cover is detected after the starting of the image formation, the stop of the feeding by the detection of nonpresence of case covers is released to enable feeding of the case cover.

Additionally, the bookbinding system can be configured in a manner that when the case cover presence detection means detects presence of a case cover, and the case cover size detection means detects a size equal to the predetermined size, the case cover is conveyed from the case cover housing means by a predetermined timing.

A twenty-first aspect of the present invention is directed to the bookbinding system according to the nineteenth aspect, wherein the stop of the feeding by the detection of the size other than the predetermined size is released if the case cover size detection means detects a case cover equal to the predetermined size after image formation based on the book content data is started in a detection state of a size other than the predetermined size.

Conventionally, there has been a difficulty of validating a size in the midway even if the case cover size detection means disposed in the case cover housing means detects the size equal to the predetermined size after the permission of the starting of the image formation. According to the twenty-first aspect, the case cover size detection means detects the size equal to the predetermined size after the starting of the image formation to release the stop of the feeding, whereby the case cover can be fed.

A twenty-second aspect of the present invention is directed to the bookbinding system according to any one of the fifteenth to twenty-first aspects, wherein a back gluing operation is stopped if the case cover presence detection means detects nonpresence of case covers, or the case cover size detection means detects a size other than the predetermined size before the back gluing operation is started for the recording sheets on which the images have been formed.

According to the sixteenth to twenty-first aspects, since the starting of the image formation is permitted even if no proper case covers have been set, a case may occur in which no case covers have been set at a point of time when image formation of the predetermined number of sheets is completed and before execution of back gluing. Thus, there is a problem of hardening of the glue if there is an interval after the execution of the back gluing to the casing step. According to the twenty-second aspect, if no proper case covers are set after the image formation, the back gluing of the image-formed recording sheet can be stopped.

A twenty-third aspect of the present invention is directed to the bookbinding system according to the twenty-second aspect, wherein the stop of the back gluing operation by the nonpresence of case covers is released if the case cover presence detection means detects presence of a case cover after the back gluing operation is stopped by the detection of the nonpresence of case covers.

If the case cove is pulled out during the execution of the back gluing, the process must be interrupted without executing the casing step.

According to the twenty-third aspect, a case cover is set to release the stop of the back gluing, whereby the process can be immediately resumed.

A twenty-fourth aspect of the present invention is directed to the bookbinding system according to the twenty-second aspect, wherein the stop of the back gluing operation by the detection of the size other than the predetermined size is released if the case cover size detection means detects equality of the case cover housed in the case cover housing means to the predetermined size after the back gluing operation is stopped by the detection of the case cover size other than the predetermined size.

According to the twenty-fourth aspect, a case cover of a proper size is set to release the stop of the back gluing, whereby the process can be immediately resumed.

A twenty-five aspect of the present invention is directed to the bookbinding system according to any one of the fifteenth to twenty-fourth aspects, wherein after completion of the back gluing operation, a casing operation is stopped if the case cover presence detection means detect nonpresence of case covers, or the case cover size detection means detects a size of the case cover housed in the case cover housing means to be other than the predetermined size before the casing operation is carried out by the casing means.

A twenty-six aspect of the present invention is directed to the bookbinding system according to the twenty-five aspect, wherein the stop of the casing operation by the detection of the nonpresence of case covers is released if the case cover presence detection means detects presence of a case cover after the casing operation is stopped by the detection of the nonpresence of case covers.

A twenty-seven aspect of the present invention is directed to the bookbinding system according to the twenty-five aspect, wherein the stop of the casing operation by the detection of the case cover size other than the predetermined size is released if the case cover size detection means detects equality of the case cover housed in the case cover housing means to the predetermined size after the casing operation is stopped by the detection of the case cover size other than the predetermined size.

If a situation of, e.g., pulling-out of the case cover during the execution of the back gluing, occurs, the casing step cannot be executed, and the process must be interrupted. According to the twenty-sixth and twenty-seventh aspects, in such a case, a case cover of a proper size is set to enable resumption of the process.

A twenty-eighth aspect of the present invention is directed to the bookbinding system according to the twenty-sixth or twenty-seventh aspect, wherein glue used for the back gluing is heated to melt at the time of releasing the stop of the casing operation, and then the casing operation is started.

According to the twenty-eighth aspect, when an obstacle is removed to enable the operation in a situation in which the casing operation is stopped during the back gluing, the glue stuck to the back is reheated to assure the bonding of the case cover and the recording sheets.

A twenty-ninth aspect of the present invention is directed to the bookbinding system according to the twenty-fifth to twenty-eighth aspects, further comprising means for notifying a stopped state if the feeding of the case cover, the back gluing or the casing operation is stopped.

During the interruption before the starting of the case bookbinding, the operator must notify the interruption in order to remove the obstacle. Thus, according to the twenty-ninth aspect, the stopped state can be notified.

According to the invention, there is no particular limitation on the notification method, and any can be used as long as it enables recognition by the operator. For example, one can be selected from the displaying of a message or an icon on the operation panel of the bookbinding system, the sounding of the buzzer in the bookbinding system, the voice guiding from speaker in the bookbinding system, the rotation of the patlight on the bookbinding system, and the notification by electronic mail from the bookbinding system to manager's personal computer.

The notification content may be designed to call attention by the buzzer or the like, indicate the interruption or instruct the method of removing the obstacle. Means can be employed to notify not only the physically unimpaired but also the physically impaired (totally blind, totally deaf or the like).

A thirtieth aspect of the present invention is directed to the bookbinding system according to any one of the first to twenty-ninth aspects, wherein the case cover housing means can sequentially stack case covers, and the case cover feeding means or the case cover conveying means can sequentially send out the stacked case covers from the bottom.

If bookbinding jobs are continuously entered, different case covers which have been outputted in parallel from different color printers may be additionally set in the case cover housing means while a first-in first-out sequence is maintained.

According to the thirtieth aspect, by employing the stacking/bottom feeding system for the case cover housing means to only stack the case covers of the books to be printed/bound from the last book being printed/bound in sequence, the book content data (text) and the case covers can be correlated in order.

A thirty-first aspect of the present invention is directed to the bookbinding system according to any one of the first to thirtieth aspects, wherein cover identification information is imparted to the case cover corresponding to content identification information held by the book content data, identification information reading means is provided for reading identification information of the case cover housed in the case cover housing means, the cover identification information is read by the identification information reading means, and compared with the content identification information, and the case cover can be fed if correspondence of both is determined in accordance with a result of the comparison.

A thirty-second aspect of the present invention is directed to the bookbinding system according to the thirty-first aspect, wherein the cover identification information is imparted to the case cover beforehand by printing or image formation.

A thirty-third aspect of the present invention is directed to the bookbinding system according to the thirty-first or thirty-second aspect, wherein the feeding of the case cover is stopped if a result of the comparison shows noncorrespondence between the cover identification information and the content identification information.

When case covers are outputted in parallel by the image formation section different from that of the book content, the case covers are set in the case cover housing means, and glued together with the image-formed book content data to complete a case bound book, if the first-in first-out order is broken because of jamming recovery or the like, the book content data and the case cover may not match each other.

According to the thirty-first, thirty-second and thirty-third aspects, the identification information is imparted to the case cover by printing or making a print, the identification information is read by the reading means, compared with the identification information of the book content data, and the casing step can be executed in accordance with the result of the comparison, it is possible to surely prevent bookbinding in the identification information unmatched state of the book content and the case cover.

A thirty-fourth aspect of the present invention is directed to the bookbinding system according to any one of the thirty-first to thirty-third aspects, further comprising notification means for notifying a state thereof if a result of the comparison shows noncorrespondence between the cover identification information and the content identification information.

If the result of the comparison shows noncorrespondence in identification information between the book content data and the case cover, the casing step must be stopped, and the unmatching must be notified.

According to the thirty-fourth aspect, the unmatched state is notified by the notification means to enable replacement of the case cover by the operator when necessary or the like.

According to the present invention, the notification means is not limited to any particular means. It is possible to dispose notification means which executes one selected from the displaying of a message or an icon on the operation panel of the bookbinding system, the sounding of the buzzer in the bookbinding system, the voice guiding from the speaker in the bookbinding system, the rotation of the patlight on the bookbinding system, and the notification by electronic mail from the bookbinding system to manager's personal computer. The notification can be made not only to the physically unimpaired but also the physically impaired (totally blind, totally deaf or the like).

A thirty-fifth aspect of the present invention is directed to the bookbinding system according to any one of the thirty-first to thirty-fourth aspects, further comprising: a plurality of case cover housing means, the housing means being placed in order; and case cover selection means for (1) reading identification information of case covers housed in the case cover housing means in accordance with the order, (2) comparing the cover identification information with the content information, and (3) targeting each of the case covers housed in the housing means to be fed if correspondence of both is determined, and if noncorrespondence is-determined, proceeding to a next order to repeat the operations (1) to (3).

When the case covers are outputted in parallel by the different image formation sections, the prepared case covers are set in the case cover housing means, and subjected to gluing together with the image-formed book content data to complete a glued case bound book, in the case of the multitray (constituted of a plurality of trays to store case covers) which comprises a plurality of case cover housing means or the like, if the feeding is stopped in a case in which there is no correspondence in identification information between the book content data and the case cover of the selected case cover housing means, case cover feeding may not be carried out irrespective of possible correspondence of the case cover in another case cover housing means.

According to the thirty-fifth aspect, even if there is no correspondence between the identification information of the case cover housed in one case cover housing means and the identification information of the book content data as described above, the case cover identification information of the other housing means is investigated one by one, and case cover feeding can be carried out if the case cover corresponding to the book content data is housed in any one of the case cover housing means.

A thirty-sixth aspect of the present invention is directed to the bookbinding system according to the thirty-fifth aspect, wherein general-purpose cover identification information is set corresponding to a plurality of content identification information, the general-purpose identification information is imparted to each of the cover cases, and the case cover selection means targets the case cover which has the general-purpose identification information to be fed if there is no case cover which has cover identification information corresponding by one to one to the book content identification information.

When the case covers are outputted in parallel by the different image formation section, the prepared case covers are set in the case cover housing means, and subjected to gluing together with the book content data to complete a glued case bound book, if dedicated case covers run out, the casting step is stopped.

According to the thirty-sixth aspect, even if there is no matched identification information, a case cover having general-purpose identification information (almighty) can be selected if available to execute the casing step.

For example, by setting a dedicated case cover in the first case cover housing means and a general-purpose case cover in the second case cover housing means, even if there is no dedicated case cover, the casing step can be executed if a general-purpose case cover is available.

A thirty-seventh aspect of the present invention is directed to the bookbinding system according to any one of the first to thirty-sixth aspects, wherein the case cover has a short side equal in length to one side of a sheet size of a recording sheet to be fed, and a long side equal to addition of a size twice as large as the other side of the sheet size of the recording sheet and a thickness of a spine.

Thus, the number of pages and a paper kind are managed to keep constant the thickness of the spine, whereby a case cover of a just matched size which needs no cutting can be provided.

A thirty-eighth aspect of the present invention is directed to the bookbinding system according to any one of the first to thirty-sixth aspects, further comprising folding means for folding a portion protruded from the sheet size by casing to the inside if the case cover has a short side equal in length to one side of a sheet size of a recording sheet to be fed, and a long side longer than addition of a size twice as large as the other side of the sheet size of the recording sheet and a thickness of a spine.

Thus, since the folding means is provided to fold the protruded portion to the inside, the case cover can be used without cutting even if the size of the case cover does not match that of the recording sheet.

The existing folding means can be used, which can be constituted of, e.g., a device for forming a fold and a folding roller.

A thirty-ninth aspect of the present invention is directed to the bookbinding system according to any one of the first to thirty-sixth aspects, further comprising fore-edge trim cutting means for cutting small a portion protruded from the sheet size by casing to the inside of a predetermined amount of the sheet size if the case cover has a short side equal in length to one side of a sheet size of a recording sheet to be fed, and a long side longer than addition of a size twice as large as the other side of the sheet size of the recording sheet and a thickness of a spine.

A just matched size is possible in the case of the dedicated case cover. However, in the case of the general-purpose case cover, a just matched size is difficult because the thickness of the spine varies.

According to the thirty-ninth aspect, the method can be provided to cut only a small protruded portion, whereby the appearance of the fore-edge trim can be improved. Additionally, the text portion (book content data) is cut (cut together) to further improve the appearance.

The small cutting means can be constituted of a proper cutter, a positioning device for positioning the cutter, a driving device for operating the cutter, etc.

A fortieth aspect of the present invention is directed to the bookbinding system according to any one of the first to thirty-sixth aspects, further comprising three-side cutting means for cutting on three sides a portion protruded from the sheet size by casing to the inside of a predetermined amount of the sheet size if the case cover has a short side longer than one side of a sheet size of a recording sheet to be fed, and a long side longer than addition of a size twice as large as the other side of the sheet size of the recording sheet and a thickness of a spine.

Thus, the protruded portion is cut on three sides to improve the appearance of the three sides. Moreover, in this case, the text portion (book content data) is cut (cut together) to further improve the appearance.

The three-side cutting means can be constituted of a proper cutter, a positioning device for positioning the cutter, a driving device for operating the cutter, etc. The small cutting means and the three-side cutting means may be constituted of common components. When a fore-edge trim is cut, the cutting can be carried out by using a partial component.

A forty-first aspect of the present invention is directed to the bookbinding system according to any one of the first to fortieth aspects, further comprising imposing means for imposing 4 surfaces so that texts of 4 pages, i.e., 2 pages on one surface, can be displayed on one recording sheet, a 4N+1st page and a 4N+4th page can be positioned on the outer side and a 4N+2nd page and a 4N+3rd page can be positioned on the inner side in a folded state of the recording sheet to instruct image arrangement to the book content image formation means when an image is formed on each of the recording sheet based on the book content data; and middle-folding means for middle-folding the recording sheet which has been subjected to the 4-imposing and the image formation.

A forty-second aspect of the present invention is directed to the bookbinding system according to the forty-first aspect, wherein the recording sheets are collected, aligned and back-glued in middle-folded states.

Conventionally, in the printing/bookbinding world, for example, by executing 4-imposing on double surfaces of one sheet, and cutting the sheet off-line to complete a glued case bound book, ½ printing costs can be realized compared with the case of simple double-surface printing. On the other hand, how the printing costs of the bookbinding system are reduced is a big problem.

According to the forty-first and forty-second aspects, the text is allocated to two pages on one surface of one recording sheet, four pages on double surfaces, and the pages are arranged so that the first of the two folds can include 1st to 4th pages, and the second can include 5th to 8th pages. Thus, compared with the case of simple double-surface printing, ½ printing costs can be realized.

DETAILED DESCRIPTION OF THE PREFERRED EMBODIMENTS

Next, the preferred embodiments of the present invention will be described in detail with reference to the accompanying drawings.

Figure 1:
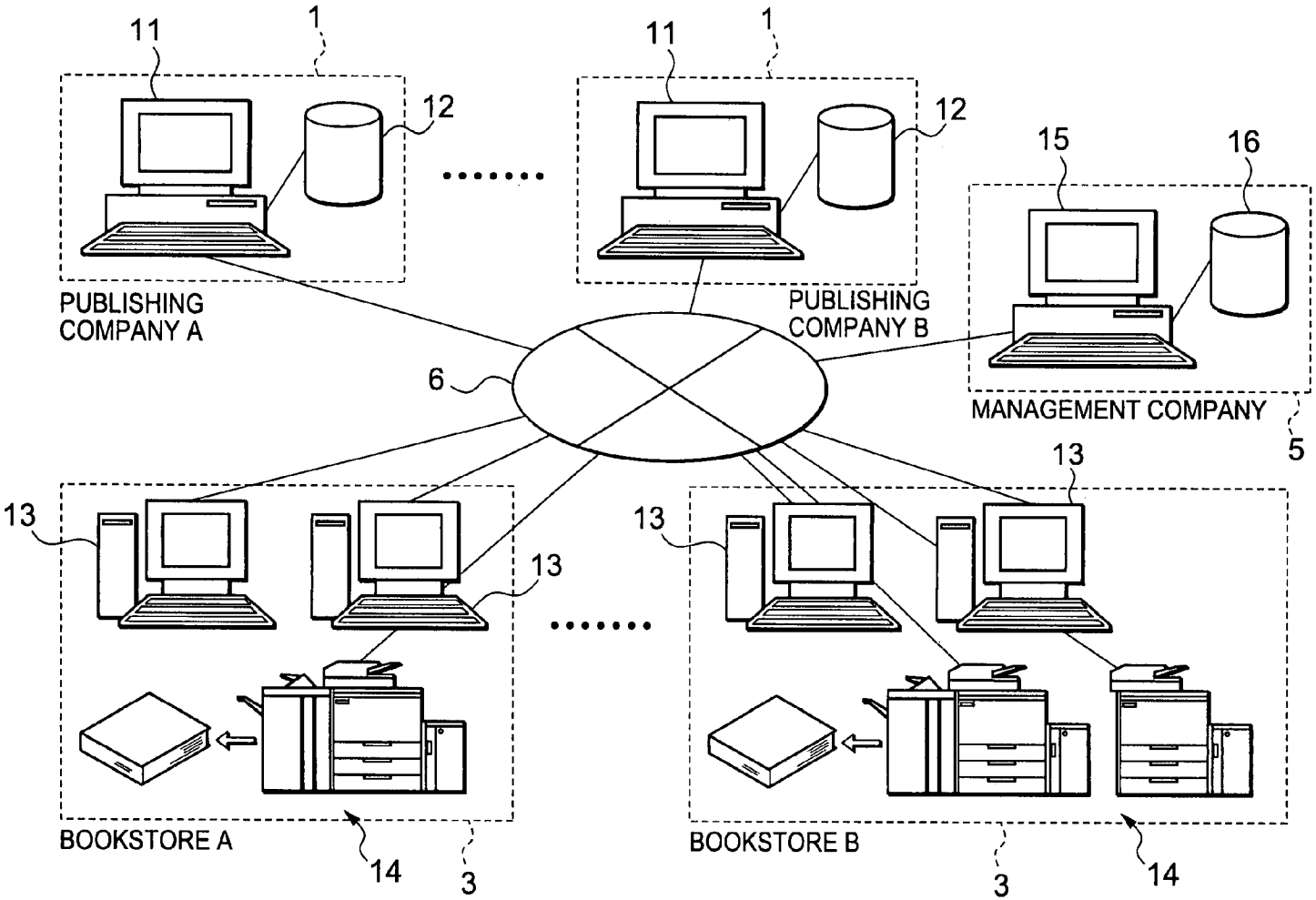
FIG. 1 a view showing a configuration example of a bookbinding system.

FIG. 1 is a view showing a configuration example of a bookbinding system, which constitutes a book on-demand system. The book on-demand system binds a book in accordance with a request of a customer to hand it to the customer. In the drawing, a reference numeral 1 denotes a data server installed at each of a plurality of publishing companies. The data servers of a publishing company A and a publishing company B are shown. A reference numeral 3 denotes a just-in book system (trademark) installed at each of a plurality of bookstores. The systems of a bookstore A and a bookstore B are shown. A reference numeral 5 denotes a management server installed at a management company which manages the bookbinding system. The publishing companies A, B (data servers 1), the bookstores A, B (bookbinding systems), and the management company (management server 5) are interconnected through a network 6. For the network 6, for example, Internet, a public line or the like is used.

Each data server 1 comprises a data server computer 11, and a database 12 connected to the computer 11. Installation places of data servers are not limited to the two companies, i.e., the publishing companies A, B, but they may be installed at a number of publishing companies. In the foregoing, the computers 11 and the databases are denoted by similar reference numerals. However, a content of data stored in the database 12 normally varies from company to company.

In the just-in book system 3, a reference numeral 13 denotes a terminal. The drawing shows an example in which two are installed at each bookstore. A reference numeral 14 denotes a bookbinding system of the present invention. The bookstores A and B are shown, but the number of bookstores is not limited to such. A number of bookstores are included. A configuration of the bookbinding system may vary from bookstore to bookstore. For example, at the bookstore A, an image formation section is constituted of a color printer. Image formation of a book content and image formation of book cover display are executed by the same color printer. Additionally, for example, at the bookstore B, a color printer and a monochromatic printer are provided as image formation sections. Then, image formation of a book content and image formation of a book cover display can be executed by the different image formation sections.

In the management server 5, a reference numeral 15 denotes a management server computer for controlling an overall operation of the bookbinding system, and 16 denotes a database connected to the management server computer 15.

Figure 2:
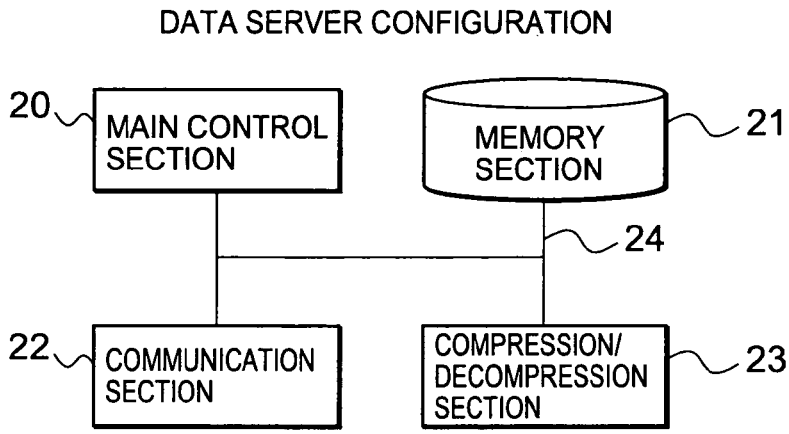
FIG. 2 is a view showing a configuration example of a data server.

FIG. 2 is a block diagram showing a configuration of the data server 1. In the drawing, a reference numeral 20 denotes a main control section for controlling an overall operation of the device, which can be constituted of, e.g., a CPU and a program for operating the CPU. A reference numeral 21 denotes a memory section for storing text (book content data) information of a book and other information. A memory device such as a hard disk device or a DVD is used to build the database 12. A reference numeral 22 denotes a communication section for communicating with the outside, which can be constituted of a network interface or the like for transferring data by a proper communication protocol. A reference numeral 23 denotes a compression/decompression section for compressing/decompressing image data, which can be constituted of, e.g., a CPU, a program for operating the CPU, a RAM for temporarily storing data, etc. The components are interconnected through a bus 24.

In the device constituted in the foregoing manner, the main control section 20 transfers image data with the database 12 disposed in the memory section 21. For example, if image data stored in the database 12 is bit map data (BMD), the data is compressed in accordance with JPEG or the like at the compression/decompression section 23, and stored in the memory section 21. The storage of the compressed image data enables efficient use of a memory area of the memory section 21.

Conversely, when the image data stored in the memory section 21 is read, the compression/decompression section 23 decompresses the read data to the original bit map data, and displays it on a display section (display: not shown). In the case of sending the image data to the network 6, the image data is sent in its compressed state through the communication section 22 to the network 6. The sent image data is entered through the network 6 to the management server 5.

Figure 3:
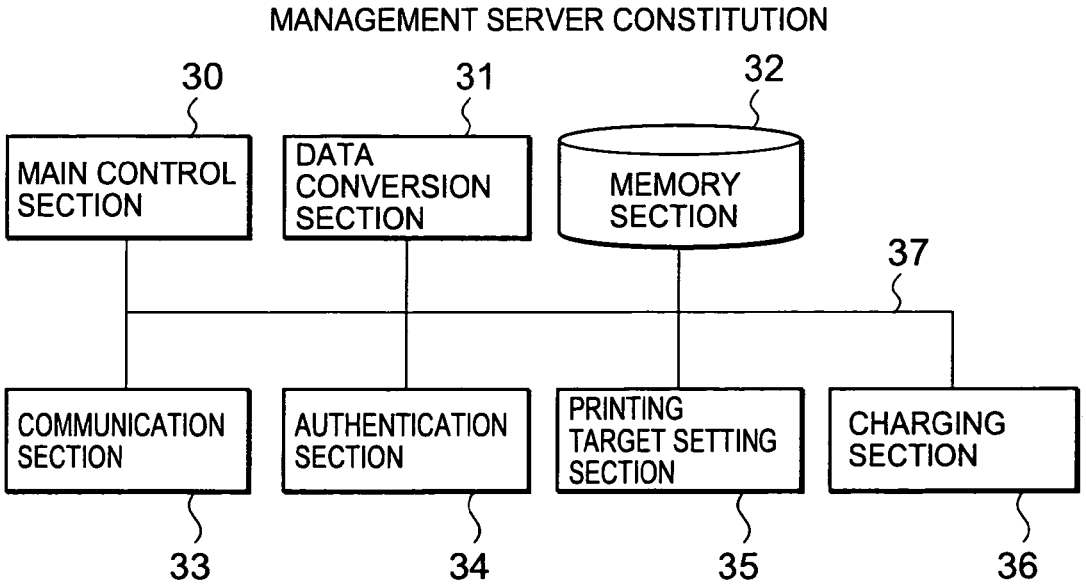
FIG. 3 is a view showing a configuration example of a management server.

FIG. 3 is a block diagram showing a configuration example of the management server 5. In the drawing, a reference numeral 30 denotes a main control section for controlling an overall operation, which can be constituted of, e.g., a CPU and a program for operating the CPU. A reference numeral 31 denotes a data conversion section for converting book content data into printing postscript (PS) data or reading data at the terminal 30, which can be constituted of a CPU and a program for operating the CPU. A reference numeral 32 denotes a memory section for temporarily storing the book content data currently read at the terminal 30. For example, a hard disk device is used to build the database 16. A reference numeral 33 denotes a communication section for communicating with the outside, which can be constituted of a network interface or the like for transferring data by a proper communication protocol. A reference numeral 34 denotes an authentication section for determining whether the terminal 13 which accesses the management server is legitimate or not. At the authentication section 34, for example, information regarding a legitimate terminal is stored in the memory section 32 or the like, information, an IP address or the like for identification which is contained in the data sent from the terminal 13 is obtained, and then this is collated with the stored information to determine whether the terminal is legitimate or not.

A reference numeral 35 denotes a printing target specification section for specifying a printing target, and 36 denotes a charging section for calculating bookbinding expenses (copyright fees, printing fees etc.). At the charging section 36, expenses for books or the like are set and stored beforehand, and the amount of charging is decided based on a book title or the like specified by communication with the terminal, and notified to the terminal.

The printing target specification section 35 specifies whether the terminal which has made a printing request is that of a preregistered bookstore or not, and specifies a proper data sever based on a book title or the like sent from the terminal simultaneously with a book reading request. A reference numeral 37 denotes a bus for interconnecting the components.

In the system configured in the foregoing manner, upon recognition of a book reading request from the terminal 13 through the network 6 and the communication section 33, the main control section 30 actuates the authentication section 34. The authentication section 34 checks on whether the terminal 13 is a preregistered terminal or not. If it is not a preregistered terminal, the authentication section 34 notifies this to the main control section 30. The main control section 30 recognizes a book title, a publishing company, an author or the like simultaneously sent in with the book reading request, actuates the printing target specification section 35, and specifies a proper data server. Then, the main control section 30 accesses the data server 1 of the relevant publishing company through the communication section 33 and the network 6 to request book content data of the book.

The data server 1 which has received the request of the book content data executes searching to determine whether relevant book content data has been stored or not in the database 12. If the relevant book content data has been stored, the data server 1 sends the book content data stored in the database 12 to the management server 5.

The main control section 30 of the management server 5 temporarily stores the book content data received through the network 6 and the communication section 33 in the memory section 32.

The main control section 30 actuates the printing target specification section 35, and specifies that the target bookbinding system 14 is a bookbinding system installed at the bookstore in which the terminal 13 which has made a book purchase request is installed. After the specification of the bookbinding system 14, the book content data stored in the memory section 32 is read, the data conversion section 31 is actuated to convert the book content data into printing postscript (PS) data, and this data is transmitted through the communication section 33 and the network 6 to the bookbinding system 14.

Figure 4:
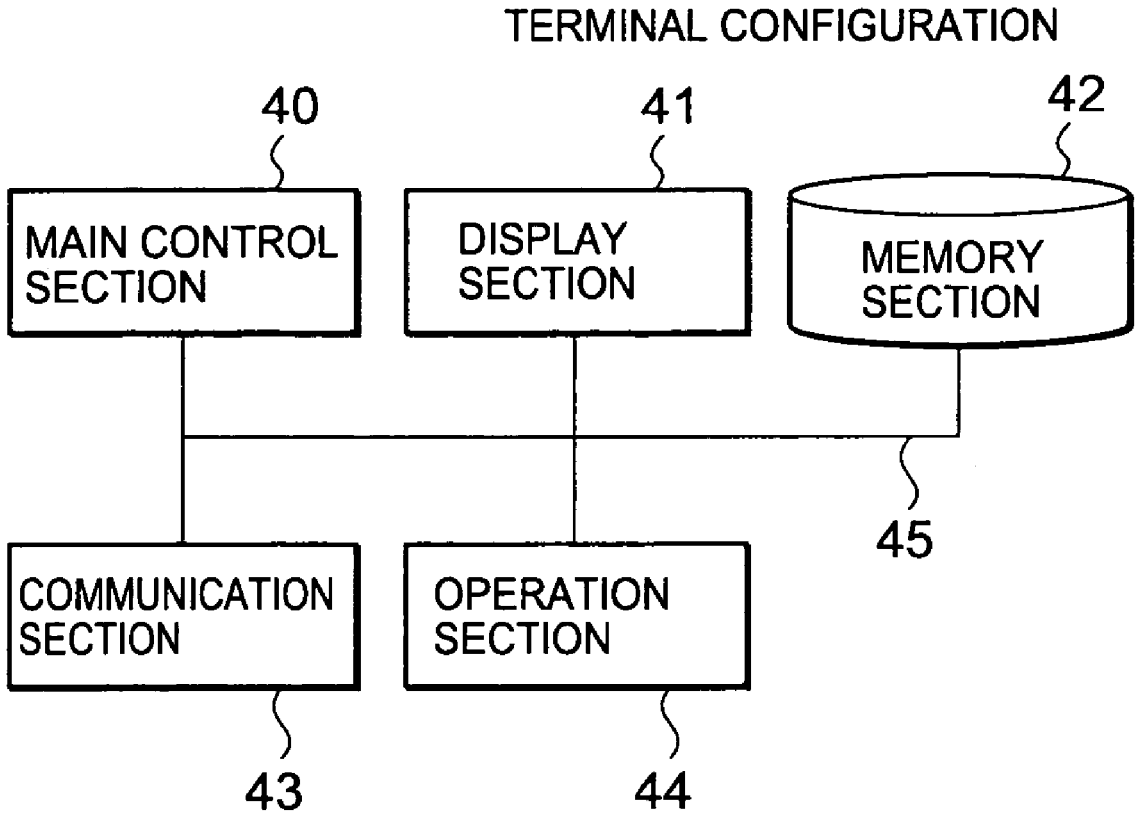
FIG. 4 is a view showing a configuration example of a terminal.

FIG. 4 is a block diagram showing a configuration example of the terminal 13. In the drawing, a reference numeral 40 denotes a main control section for controlling an overall operation, which can be constituted of, e.g., a CPU and a program for operating the CPU. A reference numeral 41 denotes a display section for displaying text (book content data) information and various other bits of information. For example, a CRT or a liquid crystal display is used. A reference numeral 42 denotes a memory section for storing reading data and other information. For example, a hard disk device is used. A reference numeral 43 is a communication section for communicating with the outside, which can be constituted of a network interface or the like for transferring data by a proper communication protocol. A reference numeral 44 denotes an operation section for entering various commands or the like. For example, a keyboard, a touch panel or the like is used. These components are interconnected through a bus 45.

In the system configured in the foregoing manner, the terminal 13 requests a book to be read to the management server 5. In this case, simultaneously with the reading request, a book title, a publishing company, an author etc., are transmitted to the server 5. When reading data is sent in from the management server 5 by the aforementioned process, the main control section 40 stores the received reading data in the memory section 42 to display it on the display section 41. Then, the operation section 44 sends a book purchase request to the management server 5, and the management server 5 issues a bookbinding start command to the bookbinding system 14, whereby the bookbinding system 14 fixes a case cover to bind a book. The bound book is handed to a purchaser at the bookstore, and the purchaser pays the predetermined amount of money for the book. Parts of the money paid for the book go to the publishing company and the management company.

Figure 5:
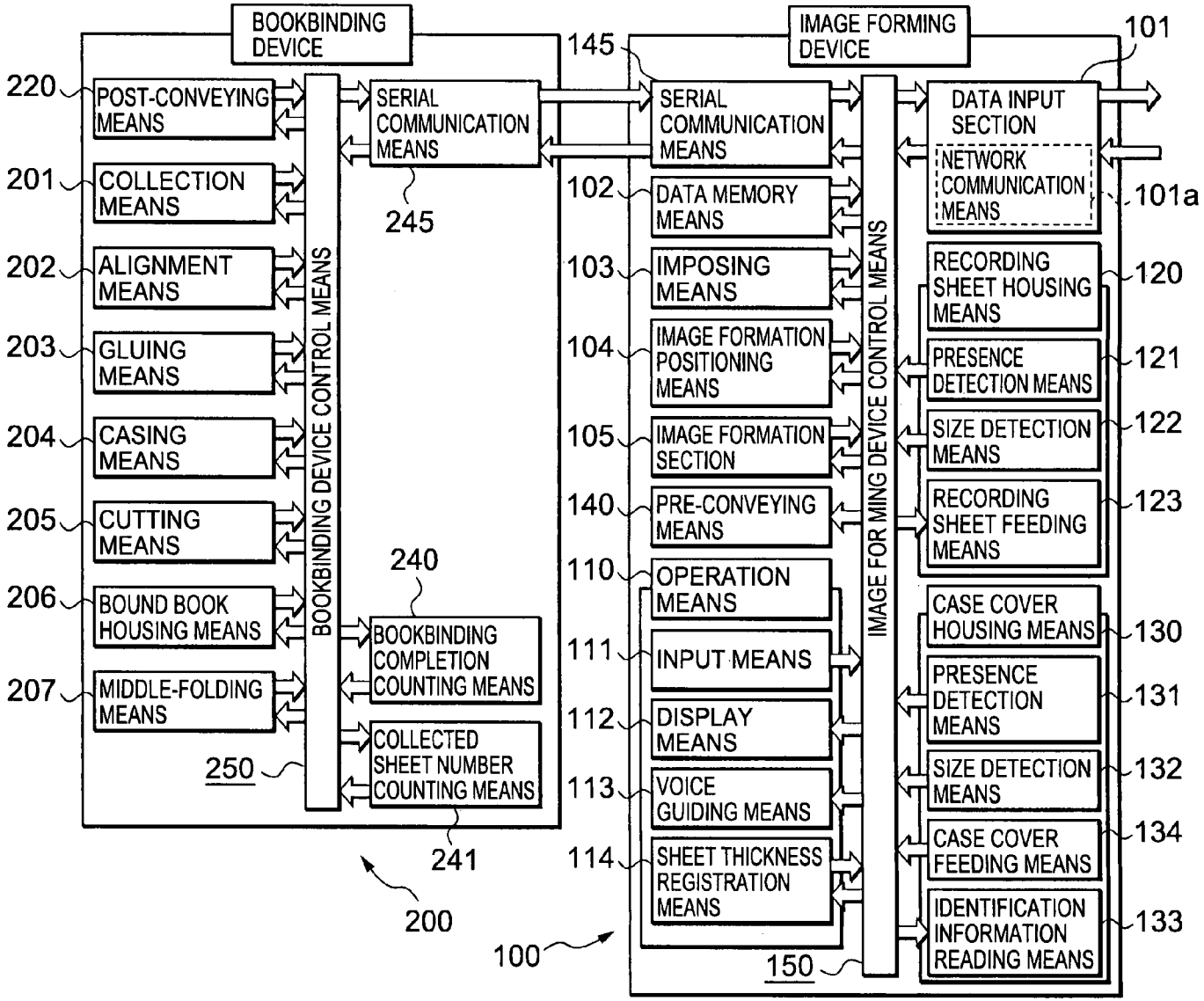
FIG. 5 is a block diagram showing a configuration of a bookbinding system according to an embodiment.

FIG. 5 is a block diagram of a functional configuration of a bookbinding system of an embodiment. The shown bookbinding system comprises an image forming device 100 which includes an image formation section of the present invention, and a bookbinding device which includes casing means of the invention.

According to the embodiment, the image forming device 100 servers both as a book content image formation section and a book cover image formation section of the present invention. In the image forming device 100, a reference numeral 101 denotes a data input section which includes network communication means 101*a* for communicating with an outside network, and constitutes a book content data input section and a book cover display data input section of the present invention. A reference numeral 102 denotes book data memory means for storing book data (constituted of book content data and book cover display data) entered through the data input section 101, which is constituted of a hard disk device. A reference numeral 103 denotes imposing means for imposing the book content on a recording sheet (allocation of image data), which can be constituted of a CPU and a program for operating the CPU. A reference numeral 104 denotes book cover image formation positioning means for calculating a case cover allocation position (allocation positions of images or characters of front cover sheet and back cover sheet) in accordance with a thickness of the back cover sheet, which cab be similarly constituted of a CPU and a program for operating the CPU. A reference numeral 105 denotes an image formation section for forming images on a recording sheet and a case cover, which constitutes a recording sheet image formation section and a cover sheet display image formation section. For the image formation section 105, for example, an image writing mechanism for forming an electrostatic latent image on a photosensitive drum, executing development in accordance with the electrostatic latent image, and transferring a developed toner image to a bookbinding sheet is used. In the case of a color image forming device, as the toner, for example, Y, M, C, or K toner is used.

An image writing unit comprises, for example, a laser diode (LD), a polygon mirror rotated to reflect an output light of the LD, an optical unit for receiving a reflected light of the polygon mirror, and a mirror for writing a laser beam passed through the optimal unit on the photosensitive drum. In addition, the image writing unit comprises a charger for uniformly charging a surface of the photosensitive drum, a developing device for developing the electrostatic latent image formed on the photosensitive drum, a transferring device for transferring the developed toner image to a sheet, a cleaning section for cleaning toner or the like left on the surface of the photosensitive drum, a fixing device for fixing the image on the sheet, etc. The image forming device comprises a double-surface mechanism for conveying a sheet reversely in order to form images on both surfaces of the sheet. For the mechanism as the image writing unit, a known mechanism can be used in the image forming device.

A reference numeral 110 denotes operation means for carrying out an operation for bookbinding, which can be constituted of an operation key or a touch panel.

The operation means 110 comprises input means 111 for entering a command or the like, display means 112 for displaying various bits of information, voice guiding means 113 for sounding a voice guide, and sheet thickness registration means 114 for registering a sheet thickness. At the sheet thickness registration means 114, the input means 111 is used to enter a thickness of one sheet for each paper kind. For example, mm is used for an input unit. Entered sheet thickness data is stored in an internal memory to be used for later-described calculation of a thickness of a back cover sheet.

The voice guiding means 113 utters a proper voice through a speaker (not shown), and functions as means for notifying a state of inhibiting paper feeding or the like and means for notifying noncorrespondence between a book content and cover identification information according to the invention.

Additionally, the image forming device of the invention enables setting of a copy mode for normal use as a copying machine and a bookbinding mode. Switching of these modes can be carried out by an input operation of an operator at the operation means 110.

Recording sheet housing means 120 comprises a sheet tray for housing recording sheets, and further comprises presence detection means 121 for detecting presence of a sheet in the tray, and size detection means 122 for detecting a size of the sheet in the tray. Recording sheet feeding means 123 is a device for delivering sheets from the tray, and constituted of a delivery mechanism or the like for delivering sheets from the feed tray, and a roller or the like for transferring the recording sheet to the image formation section 105.

The recording sheet housing means 120 may comprise a manual tray. The manual tray is suited to conveying of a thick recording sheet as the number of paper bending steps is small.

Case cover housing means 130 disposed in the image forming device 100 comprises a tray for housing a dedicated or general-purpose case cover used for image formation, and further comprises presence detection means 131 for detecting presence of a sheet in the tray, and size detection means 132 for detecting a size of the sheet in the tray. A reference numeral 133 denotes identification information reading means for reading identification information imparted to the case cover, and a proper device is used depending on an identification information imparting method. For example, a device for obtaining information by CCD optical reading is used. Case cover feeding means 134 is a device for delivering the case cover from the tray, and constituted of a delivery mechanism for delivering the case cover from the tray, and a roller or the like for transferring the case cover to the image formation section 105.

The case cover housing means 130 may have a plurality of trays. Each tray can receive a plurality of kinds of different-size case covers, and a desiccated cover or a general-purpose cover can be housed in each tray.

The case cover housing means 130 may comprise a manual tray. The manual tray is suited to conveying of a thick case cover as the number of paper bending steps is small.

Pre-conveying means 140 is a device for conveying the recording sheet and the case cover on which the images have been formed from the image forming device 100 to a bookbinding device 200, which constitute parts of the recording sheet conveying means and the case cover conveying means of the present invention.

A reference numeral 145 denotes serial communication means connected to serial communication means 245 of the bookbinding device 200 side. A reference numeral 150 denotes image forming device control means for controlling each component of the image forming device 100. The image forming device control means 150 can be constituted of, e.g., a CPU and a program for operating the CPU. According to the present invention, the image forming device control means 150 for controlling an overall operation of the image forming device is disposed on the image forming device 100 side, the bookbinding device control means 250 for controlling an overall operation of the bookbinding device is disposed on the bookbinding device 200 as described later, and the image forming device control means 150 and the bookbinding device control means 250 are interconnected through the serial communication means 145, 245. Thus, linkage can be carried out smoothly between the image forming device 100 and the bookbinding device 200.

The bookbinding device 200 comprises the serial communication means 245 connected to the serial communication means 145 of the image forming device 100.

Post-conveying means 220 continuously conveys the recording sheet and the case cover on which the images have been formed by the image forming device 100 and which have been conveyed by the pre-conveying means 140 to casing means 204 in the bookbinding device 200. The pre-conveying means 140 and the post-conveying means 220 constitute recording sheet conveying means and case cover conveying means of the invention.

A reference numeral 201 denotes collection means for collecting printed sheets, 202 alignment means for aligning printed bound sheets, 203 gluing means for gluing a back cover sheet portion of the bound sheet, 204 cover means for binding a case cover, and 205 cutting means for cutting an end so that a bound book can be within a prescribed size, which functions as small cutting means and three-way cutting means. A reference numeral 206 denotes bound book housing means for housing a bound book, and 207 middle-folding means for folding the recording sheet at a middle when a middle-folding system is employed.

A reference numeral 240 denotes bookbinding completion counting means for counting the completion of bookbinding, and 241 collected sheet number counting means for counting the number of collected sheets. The bookbinding completion counting means 240 counts the completion of bookbinding, adds information specifying a book to the information thereof, and notifies this through the network 6 to the charging section 36 of the management server 5. The charging section 36 receives a signal from the bookbinding completion counting means 240 through the network 6, and carries out charging in accordance with the number of books. The connected sheet number counting means 241 counts the number of recording sheets collected by the collection means 201. A result of the counting is notified through the serial communication means 245, 145 to the image formation positioning means 104 of the image forming device 100.

A reference numeral 250 denotes bookbinding device control means connected to each of the aforementioned components to carry out bookbinding control. The bookbinding device control means 250 can be constituted of, e.g., a CPU and a program for operating the CPU.

In the bookbinding system, one method of use is that the image forming device 100 is set as a color printer, book content data and cover sheet display data are printed on a recording sheet and a case cover, and conveyed in-line to the bookbinding device to complete a case bound book.

Another method of use is that the image forming device 100 is set as a monochromatic printer, book content data is printed on a recording sheet, cover sheet display data is ink-printed on a case cover offset printed by general-purpose design, and both are conveyed in-line to the bookbinding device to complete a case bound book.

Figure 6:
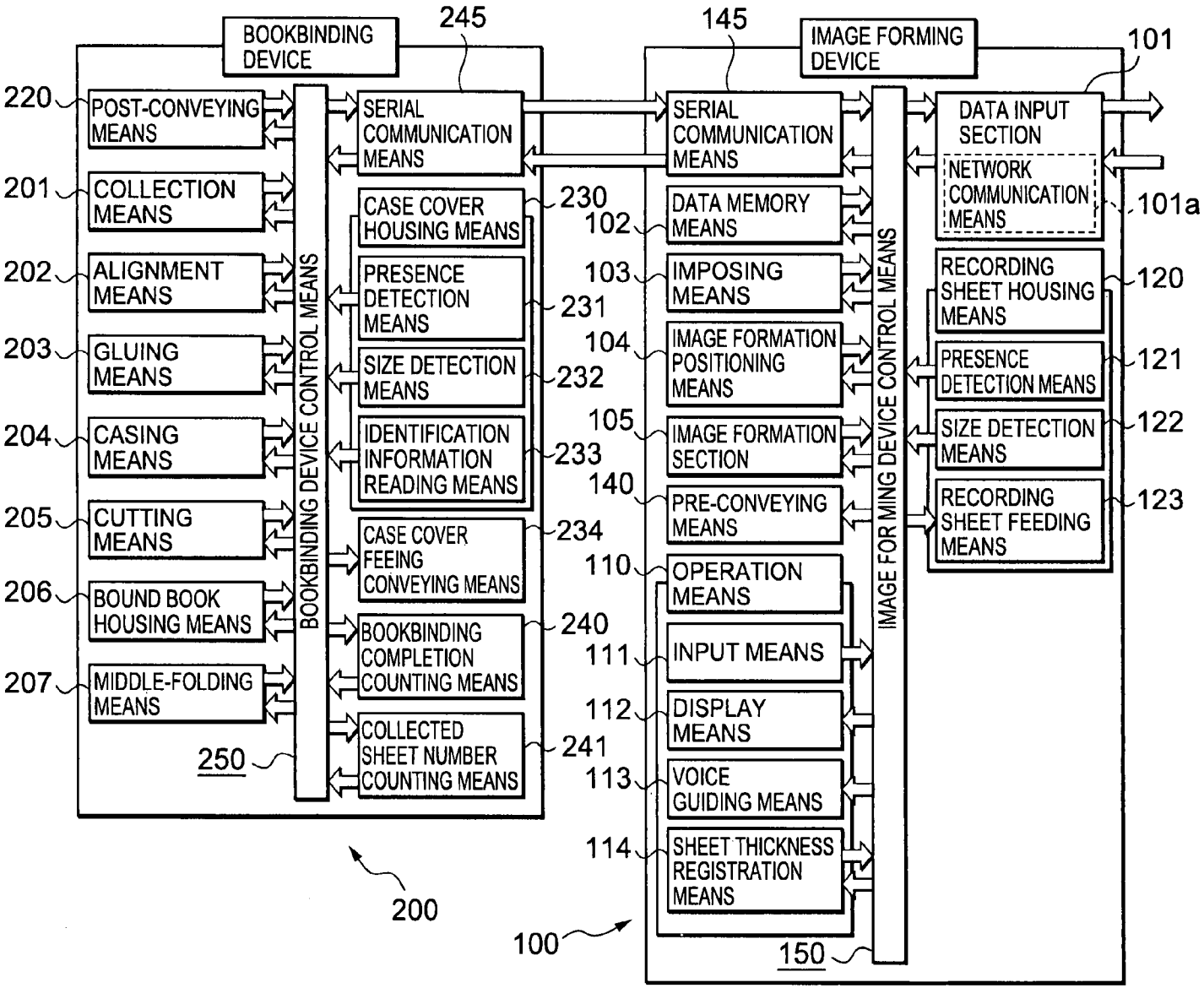
FIG. 6 is a block diagram showing a configuration of a bookbinding system according to a modified example.

FIG. 6 shows a modified example of the bookbinding system, shown in FIG. 5. In place of the case cover housing means 130, case cover housing means 230 is disposed in the bookbinding device 200.

That is, the bookbinding device 200 comprises the case cover housing means 230 for housing a dedicated case cover on which printing or image formation has been completed.

The case cover housing means 230 comprises a tray for housing a case cover, and further comprises presence detection means 231 for detecting presence of a sheet in the tray, and size detection means 232 for detecting a size of the sheet in the tray. A reference numeral 233 denotes identification information reading means for reading identification information imparted to the case cover, and a proper device is used depending on an identification information imparting method. For example, a device for obtaining information by CCD optical reading is used. Case cover feeding means 234 is a device for delivering the case cover from the tray, and constituted of a delivery mechanism for delivering the case cover from the tray, and a roller or the like for transferring the case cover to later-described casing means 204. The presence detection means 231, the size detection means 232, and the identification information reading means 233 can be similar in constitution to the presence detection means 131, the size detection means 132, and the identification information reading means 133.

As a method of using the bookbinding system, a method can be cited which sets the image forming device 100 as a monochromatic printer, prints book content data on a recording sheet, conveys it in-line to the bookbinding device, and feeds a case cover on which cover sheet display design has been offset printed by general-purpose design to the bookbinding device to complete a case bound book.

Figure 7:
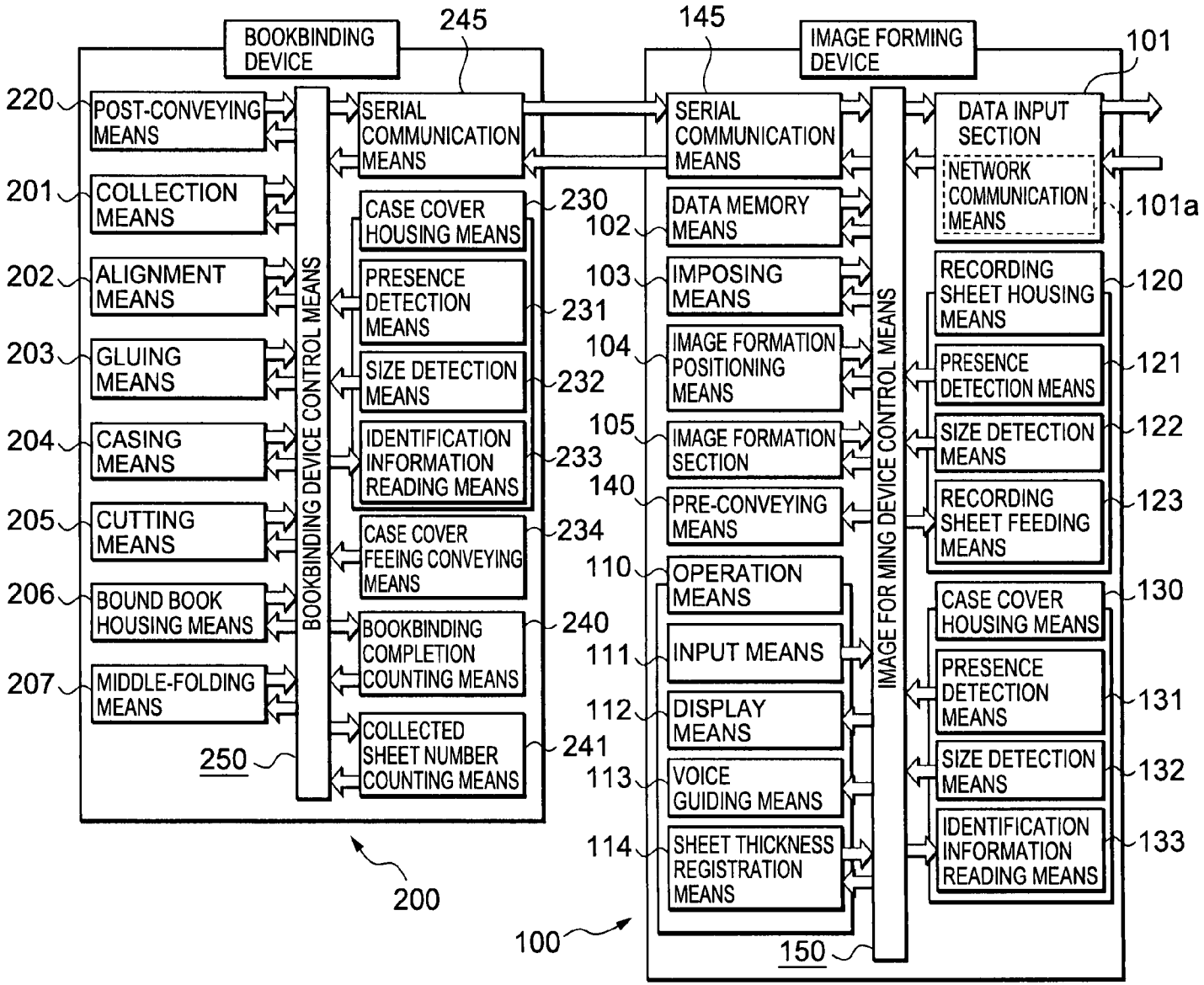
FIG. 7 is a block diagram showing a configuration of a bookbinding system according to a modified example.

FIG. 7 shows yet another modified example of the system shown in FIG. 5. In addition to the case cover means 130 on the image forming device side, the system comprises case cover housing means 230 on the bookbinding device 200 side. As in the previous case, the system comprises presence detection means 231, size detection means 232, identification information reading means 233, and case cover feeing conveying means 234. The case cover feeding conveying means 234 continuously conveys a case cover housed in the case cover housing means 230 to the casing means 204 in the bookbinding device 200.

The case cover means 130 and the case cover means 230 can be selectively used depending on a kind of used case cover (presence of formed image).

According to this bookbinding system, the methods of using the bookbinding systems shown in FIGS. 5, 6 can be properly selected.

Figure 8:
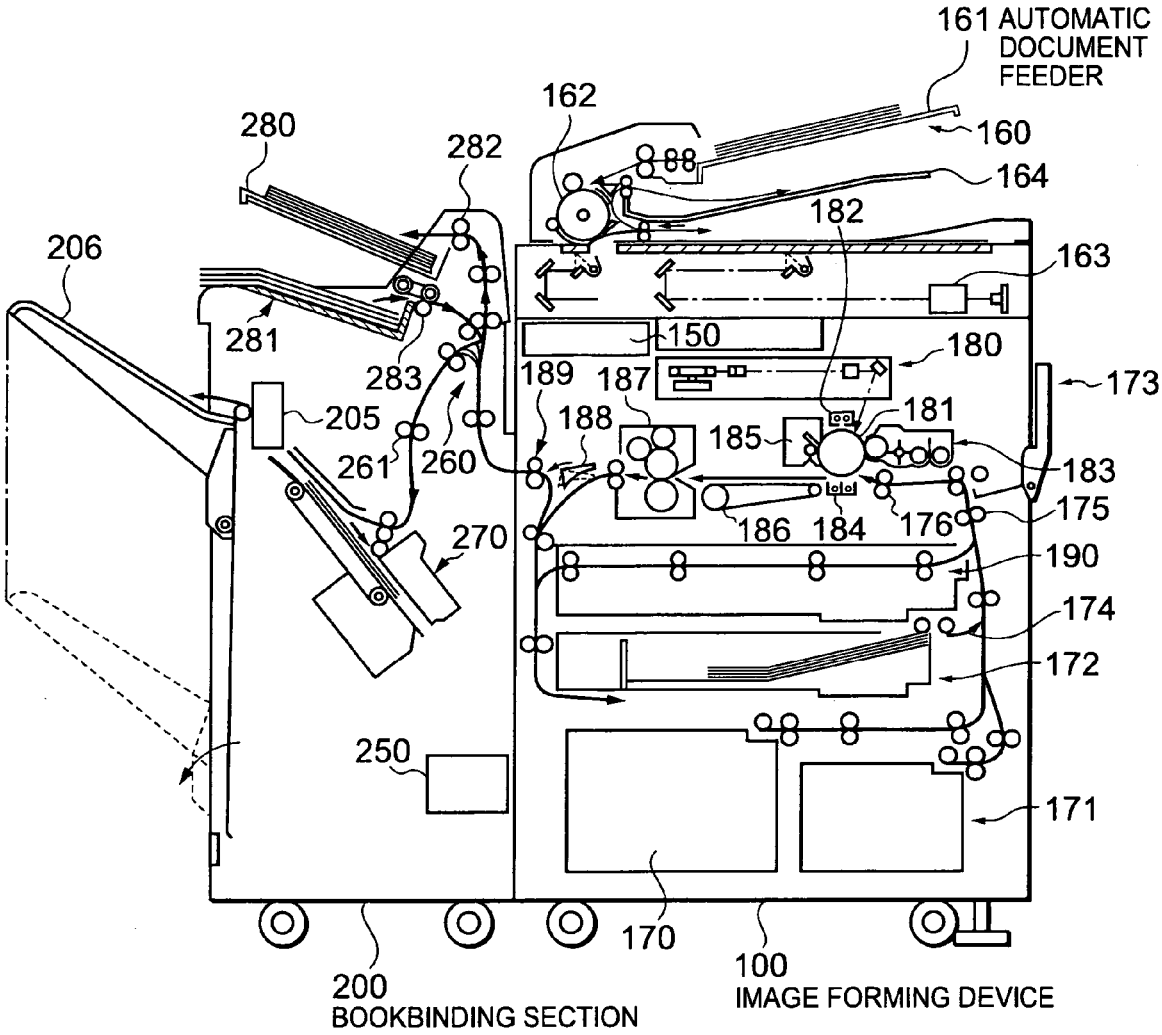
FIG. 8 is a view showing a mechanical structure of the bookbinding system of the embodiment.

FIG. 8 shows a mechanical configuration example of each of the bookbinding systems of FIGS. 5 to 7. Portions similar to those of FIGS. 5 to 7 are denoted by similar reference numerals. In the drawing, 100 denotes an image forming device, and 200 a bookbinding device. In the image forming device 100, a reference numeral 160 denotes an automatic document feeder (ADF) for automatically feeding a document to a document reading unit. The document mounted on an upper stage tray 161 of the automatic document feeder 160 is read by a document reading unit 163 while being wound and rotated by a rotation section 162. The read document is discharged to a lower stage tray 164 by a conveying section.

In the case of a double-surface document, it is wound again by the rotation section 162, and the document of the backside is read by the document reading unit 163 during further rotation. Alternatively, the document is set on the platen of a glass surface, and scanned to be read by the document reading unit 163. A reference numeral 163 denotes the document reading unit for reading the document fed from the automatic document feeder 160. The automatic document feeder 160 and the document reading unit 163 are not components of the present invention, and thus further description is omitted.

Reference numerals 170, 171, 172 denote feed trays as recording sheet housing means 120 or case cover housing means 130 on which sheets are mounted. The plurality of feed trays are disposed because it is necessary to use a plurality of kinds of different-size sheets. Here, description will be made of a case in which sheets are mounted on the feed tray 172. A reference numeral 174 a delivery section for delivering the sheets mounted on the feed tray 172. Specifically, a roller is used as the delivery section 174. The feed tray 172 and the delivery section 174 constitute the recording sheet housing means 120 or the case cover housing means 130 of FIG. 5. A reference numeral 175 denotes a paper feeding section for conveying the sheets delivered from the feed tray 172 to a resist roller 176.

A reference numeral 180 denotes an image writing unit for writing an image on a photosensitive drum 181. The image writing unit 180 comprises a laser diode (LD), a polygon mirror for rotating and reflecting an output light of the LD, an optical unit for receiving a reflected light of the polygon mirror, and a mirror for writing a laser beam passed through the optical unit on the photosensitive drum 181. The reference numeral 181 denotes the photosensitive drum, and 82 a charger for uniformly charting the surface of the photosensitive drum.

A reference numeral 183 denotes a developing device for developing an electrostatic latent image formed on the photosensitive drum 181, 183 a transferring device for transferring a toner image to a sheet, and 184 a cleaning section for cleaning toner or the like left on the surface of the photosensitive drum 181. A reference numeral 185 denotes a conveying section for conveying the sheet to which the image has been transferred, and 186 a fixing section for receiving the sheet conveyed through the conveying section 185 to fix the image. The conveying section up to the outlet side of the image forming device 100 including the conveying section 185 constitutes pre-conveying means 140 of FIGS. 5 to 7.

A reference numeral 188 denotes a switching device for sending the sheet on which the image has been fixed to a reverse conveying section 190 during a double-surface copy mode. The switching device 188 sends the sheet to the bookbinding device 200 side during a one-surface print mode or when double-surface printing is finished. The reference numeral 190 denotes the reverse conveying section. A reference numeral 189 denotes a discharge roller for discharging sheets from the image forming device 100 side. A reference numeral 173 denotes a manual tray. The drawing shows a closed state of the manual tray 173. When used, this manual tray 173 is depressed open to manually feed the sheets. This manual tray 173 is suited to conveying of a thick case cover since the number of paper bending steps is small. A reference numeral 150 denotes a control section which is image forming device control means for controlling an overall operation of the image forming device.

Next, a configuration of the bookbinding device side will be described. Reference numerals 260, 261 denote conveying sections for conveying the sheets sent from the image forming device 100 side. The conveying sections 260, 261 constitute post-conveying means of FIGS. 5 to 7.

A reference numeral 270 denotes a gluing case bookbinding section for collecting the sheets sent from the conveying sections 260, 261, aligning them, and gluing back cover sheet portions thereof to complete a case bound book. The gluing case bookbinding section 270 is constituted to serve as the collection means 201, the alignment means 202, the gluing means 203, the casing means 204 and the middle-folding means among the components shown in FIGS. 5 to 7. A reference numeral 205 denotes a cutting section for cutting unnecessary portions in order to improve an appearance of a bound book sent from the gluing case bookbinding section 270. A reference numeral 206 denotes a housing section as housing means for housing the bound book from which the unnecessary portions have been cut by the cutting section 205. The housing section 206 is constituted such that its position can be moved to a lower side each time a bond book is housed.

A reference numeral 280 denotes a first case cover feed tray on which a case cover is mounted, and 281 a second case cover feed tray on which other kinds of case covers are mounted, which constitute case cover housing means 230 shown in FIGS. 6, 7. In FIG. 8, case cover presence detection means 231, size detection means 232, and identification information reading means 233 are not shown. Reference numerals 282, 283 denote delivery rollers as delivery means disposed on the outlet sides of the case cover feed trays 280, 281. The case cover feed trays 280, 281, the delivery rollers 282, 283, and the conveying section 261 constitute case cover feeding conveying means 234. A reference numeral 250 denotes a control section as bookbinding device control means for controlling an overall operation of the bookbinding device 200.

The bookbinding system which comprises one image forming device and a bookbinding device has been described. However, the system may comprise image forming devices for forming an image on a recording sheet and an image on a cover case. Hereinafter, description will be made of the bookbinding system which comprises an image forming device for forming an image on a recording sheet and an image forming device for forming an image on a case cover.

Figure 9:
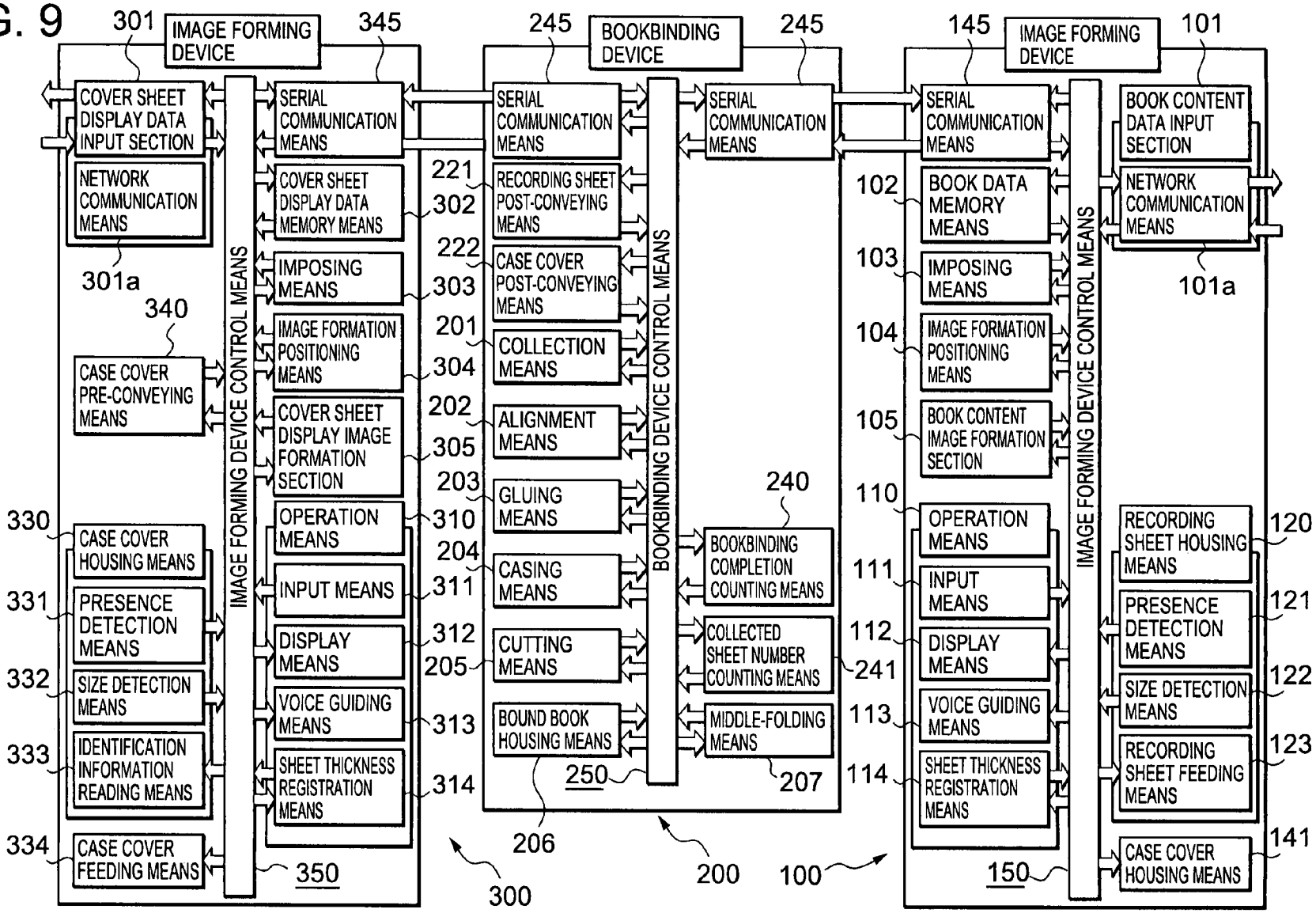
FIG. 9 is a block diagram showing a configuration of a bookbinding system according to another embodiment.

FIG. 9 is a block diagram showing a bookbinding system which comprises an image forming device 100, an image forming device 200 and a bookbinding device 200. Components similar to those of the foregoing bookbinding system are denoted by similar reference numerals, and description thereof will be omitted or simplified.

In the bookbinding system, the image forming device 100 functions as a book content image formation section for forming an image on a recording sheet. The image forming device 300 functions as a cover sheet display image formation section for forming an image on a case cover. The image forming device 100 comprises recording sheet housing means 120 for housing a recording sheet on which an image is formed, and recording sheet pre-conveying means 141 for conveying the recording sheet on which the image has been formed in-line to the bookbinding device 200. On the other hand, the image forming device 300 comprises case cover housing means 330 for housing a case cover on which an image is formed, and case cover pre-conveying means 340 for conveying the case cover on which the image has been formed in-line to the bookbinding device 200. The case cover housing means 330 comprises a tray for housing a dedicated or general-purpose case cover used for image formation, presence detection means 331 for detecting presence of a sheet in the tray, size detection means 332 for detecting a size of the sheet in the tray, and identification information reading means 333 for reading identification information imparted to the case cover. For the identification information reading means 333, a proper device is used depending on an identification information imparting method. For example, a device for obtaining information by CCD optical reading is used. Case cover feeding means 334 is a device for delivering the case cover from the tray, which is constituted of a delivery mechanism for delivering the case cover from the tray, a roller for transferring the case cover to an image formation section 305 for displaying a cover sheet, etc. The image formation section 305 can be similar in constitution to the image formation section 105.

The recording sheet pre-conveying means 141 and the case cover pre-conveying means 340 are devices for conveying the recording sheet and the case cover on which images have been formed to the image forming devices 100, 300, which constitute parts of recording sheet conveying means and case cover conveying means of the present invention. The bookbinding device 200 comprises recording sheet post-conveying means 221 and case cover post-conveying means 222, which convey the recording sheet conveyed by the recording sheet pre-conveying means 141 and the case cover conveyed by the case cover pre-conveying means 340 to the casing means 204.

The image forming device 300 comprises a cover sheet display data input section 301 to which cover sheet display data passed through a network can be entered through network communication means 301*a*. The input section 301 comprises cover sheet data memory means 302 for storing the entered cover sheet data. The image forming device 300 comprises serial communication means 345 as in the case of the image forming device 100, which enables communication with serial communication means 245 of the bookbinding device.

In the image forming device 300, the reference numeral 302 denotes the cover sheet display data memory means for storing the cover sheet display data entered through the data input section 301, which is constituted of a hard disk device or the like. A reference numeral 303 denotes imposing means for imposing a cover sheet display on the case cover (allocation of image data), which can be constituted of a CPU and a program for operating the CPU. A reference numeral 304 denotes cover sheet image formation positioning means for calculating an allocation position of the case cover (allocation positions of images or characters of front and back cover sheets) in accordance with a thickness of a back cover sheet, which can similarly be constituted of a CPU and a program for operating the CPU.

The imposing means 303, the image positioning means 304, operation means 310, input means 311, display means 312, voice guiding means 313, and sheet thickness registration means 314 can be similar in constitution to the imposing means 103, the image positioning means 104, the operation means 110, the input means 111, the display means 112, the voice guiding means 113 and the sheet thickness registration means 114. A reference numeral 305 denotes a control section as bookbinding device control means for controlling an overall operation of the image forming device 300.

In the bookbinding system, one method of use is that book content data is printed on a recording sheet by the image forming device 100, and conveyed in-line to the bookbinding device. On the other hand, at the image forming device 300, the cover sheet display data is printed fully or by ink on a cover sheet, and conveyed in-line to the bookbinding device 200 to complete a case bound book together with the recording sheet.

Next, as a modified example of the bookbinding system of FIG. 9, description will be made of a bookbinding system which comprises case cover housing means 230 in the bookbinding device 200 in addition to the components of the foregoing bookbinding system by referring to FIG. 10.

Figure 10:
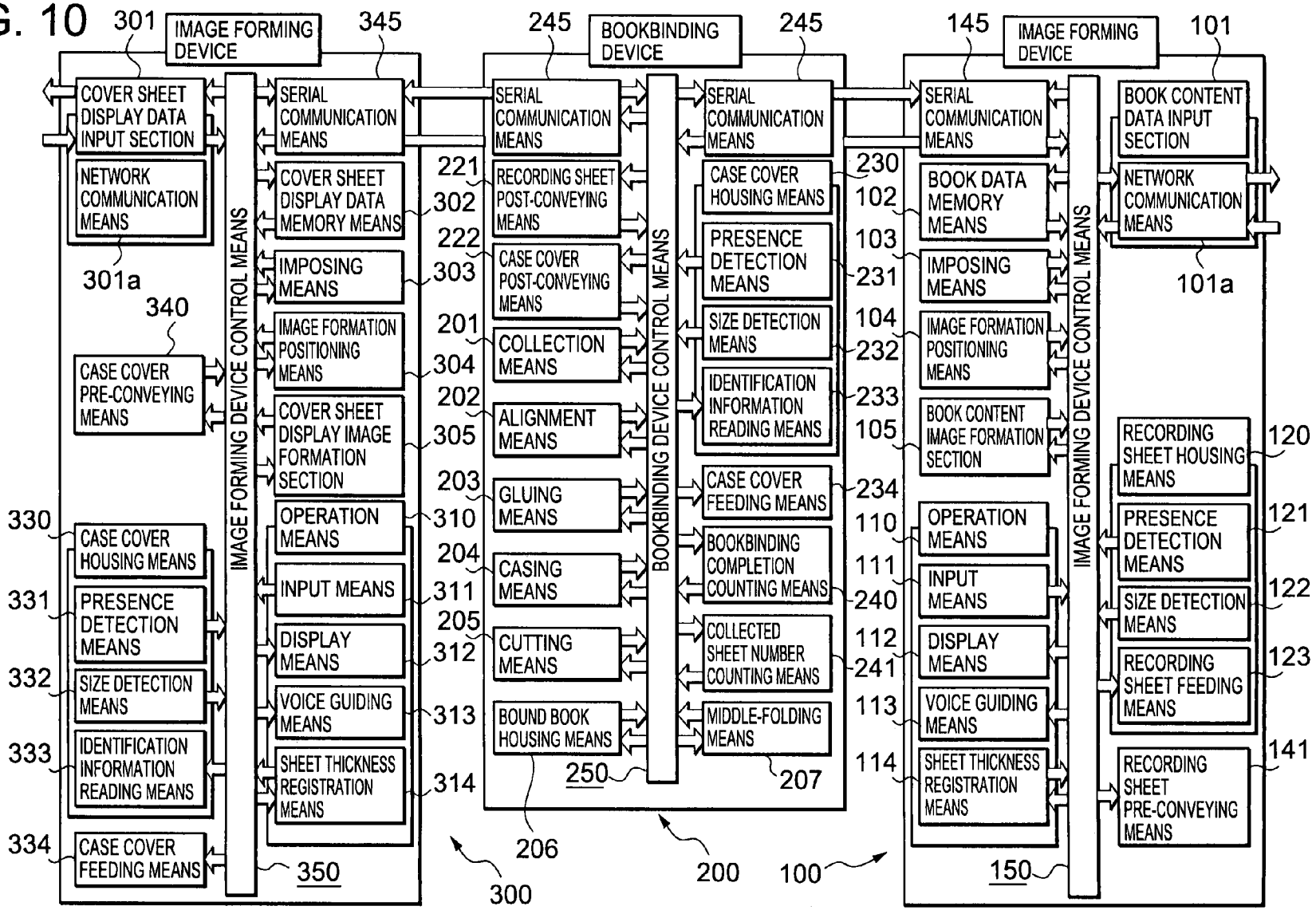
FIG. 10 is a block diagram showing a configuration of a bookbinding system according to a modified example.

FIG. 10 is a block diagram showing the bookbinding system. Components similar to those of the foregoing bookbinding system are denoted by similar reference numerals, and description thereof will be omitted or simplified.

According to the bookbinding system, the image forming device 300 comprises case cover housing means 330, and the bookbinding device 200 comprises the case cover housing means 230, and comprises presence detection means 231 for detecting presence of a sheet, size detection means 232 for detecting a size of a sheet, identification information reading means 233 for reading identification information imparted to the case cover, and case cover feeing conveying means 234 which accompany the case cover housing means 230. These components can be similar in constitution to those of the bookbinding system (FIGS. 6, 7).

The case cover housing means 230 and the case cover housing means 330 are selectively used. In the case of using the case cover housed in the case cover housing means 230, similarly to the aforementioned bookbinding system, at the image forming device 200, printing is carried out fully on the case cover or ink-printing is carried out on a case cover offset printed by a general-purpose design, and conveyed in-line to the bookbinding device 200 to complete a case bound book together with a recording sheet in which printing has been carried out by the image forming device 100 and conveyed in-line to the bookbinding device 200. On the other hand, in the case of using the cover case housed in the case cover housing means 330, the case cover on which offset printing has been completed is conveyed to the casing means 204 by the case cover feeding conveying means 234 to complete a case bound book together with a recording sheet on which printing has been carried out by the image forming device 100 and conveyed in-line to the bookbinding device 200.

Figure 11:
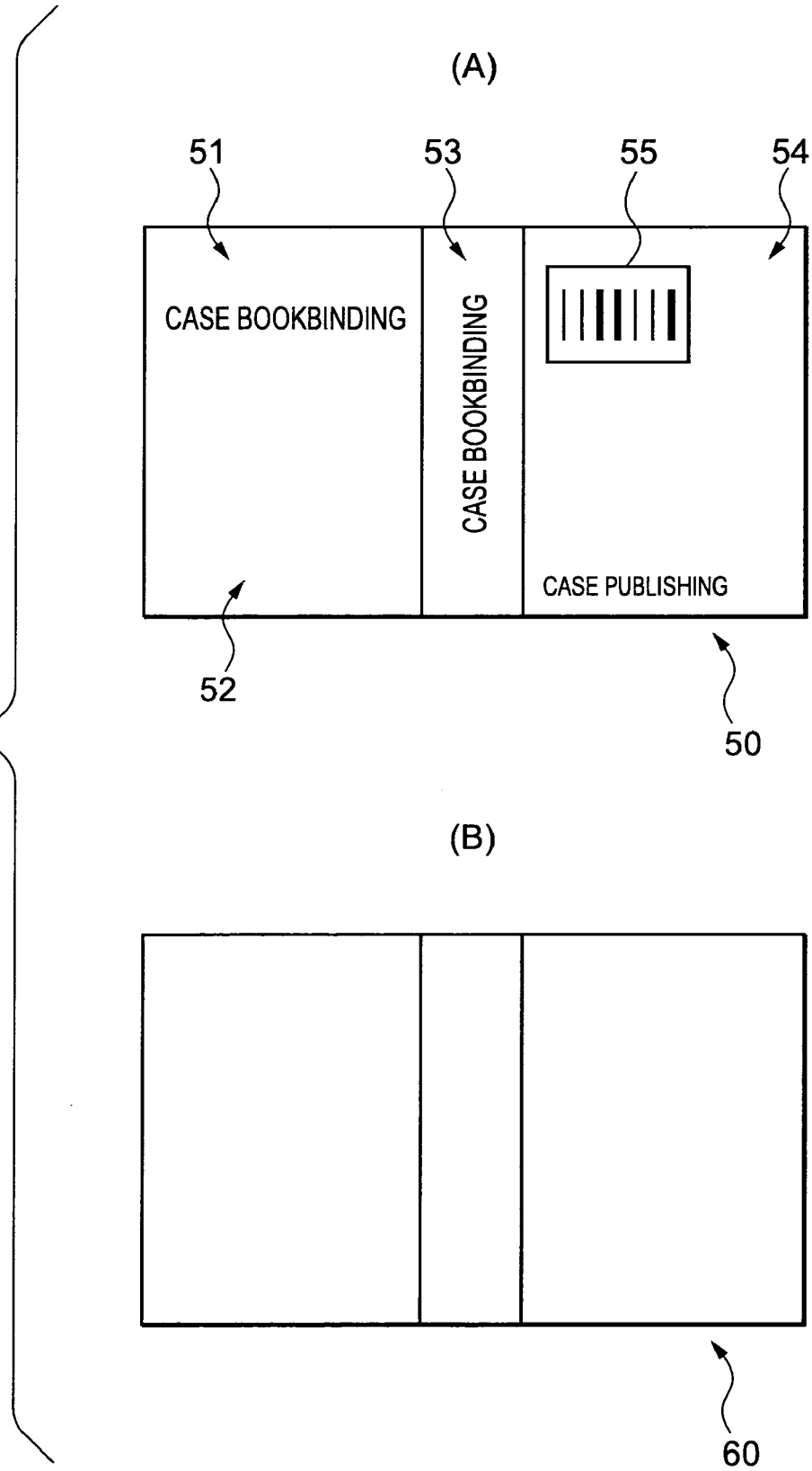
FIG. 11 is views showing kinds of case covers.

FIG. 11 shows kinds of case covers used in the bookbinding system. FIG. 11(A) shows a dedicated case cover and (B) shows a general-purpose case cover. In (A), a reference numeral 50 denotes a case cover, 51 a book title, 52 a front cover sheet area, 53 a cover sheet area, and 54 a back cover sheet area. A reference numeral 55 denotes a bar code which indicates a book price or the like attached to the case cover 50. On the other hand, a general-purpose case cover 60 shown in FIG. 11B has no printed book title or the like, uses general-purpose design, and can be used for binding a plurality of kinds of books.

The book title "case bookbinding" or the like on the dedicated case cover 50 may be preprinted on the case cover 50 to complete a cover sheet display, or printed on the dedicated case cover 50 by using the image forming devices 100, 300 of the system of the invention. The case cover on which the cover sheet display has been completed by offset printing or the like is normally housed in the case cover housing means 230 disposed in the bookbinding device 200. On the other hand, the general-purpose case cover 60 or the dedicated case cover 50 on which displays are added by ink-printing or the like is housed in the case cover housing means 130 of the image forming device 100 or the case cover housing means 330 of the image forming device 300.

Next, a bookbinding process in the bookbinding system will be described.

Figure 12:
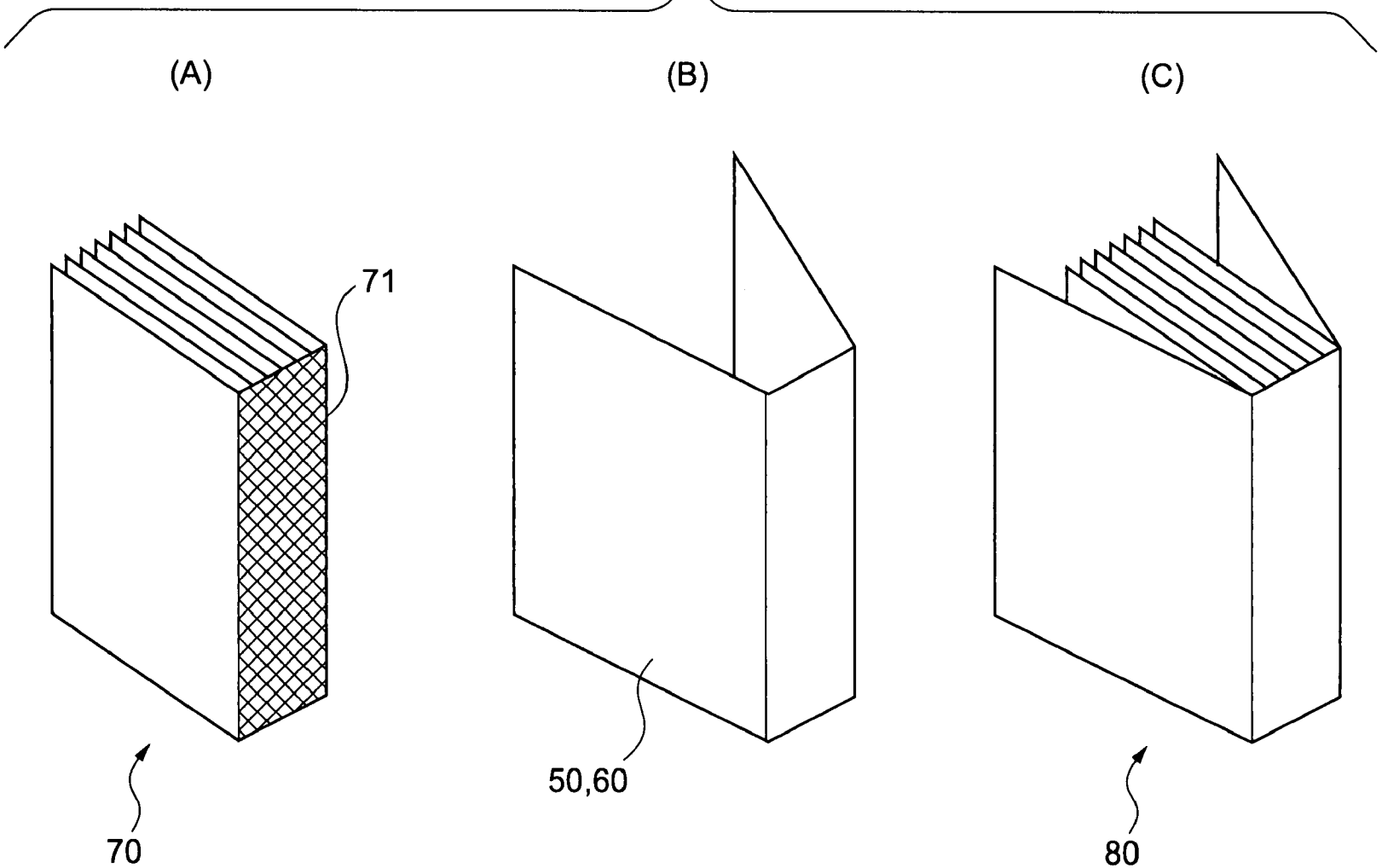
FIG. 12 shows a process until case binding is finished according to the present invention.

According to the system of the aforementioned configuration, in accordance with a request from the terminal 13, book content data and cover sheet display data converted into printing data are sent from the management server 16 as described above. In the bookbinding system shown in FIGS. 5 to 8, the data are temporarily stored in the data memory means 102 by the image forming device control means 150, and imposition of images formed on a recording sheet and a case cover is decided by the imposing means 103 as occasion demands. Then, images are formed on a recording sheet 70 and a case cover 50 or a case cover 60 at the image forming device 100. At the bookbinding device 200, as shown in FIGS. 12A to 12C, a backside of the recording sheet 70 is glued to form a back gluing section 71, and the case cover 50 or 60 is bonded to the back gluing section 71 to carry out case bookbinding, whereby a desired book 80 is obtained. If the printing of the cover sheet display has been completed on the case cover by the offset printing or the like, transfer of the cover sheet display data, imposing and image formation on the case cover are omitted.

In the bookbinding system shown in FIGS. 9, 10, data converted into printing data is sent from the management server 100 to the image forming device 100, and cover sheet display data is sent to the image forming device 300. At the image forming device 100, the book content data is temporarily stored in the data memory means 102 by the image forming device control means 150, and imposing of images formed on a recording sheet is decided by the imposing means 103 as occasion demands. Then, at the image forming device 100, an image is formed on a recording sheet 70, and conveyed to the bookbinding device 200. At the image forming device 300, the cover sheet display data is temporarily stored in the data memory means 302 by the image forming device control means 350, and imposing of images on a case cover is decided by the imposing means 303 as occasion demands. Then, at the image forming device 300, an image is formed on the case cover 50 or a case cover 60, and conveyed to the bookbinding device 200. At the bookbinding device 200, the recording sheet conveyed from the image forming device 100 and the case cover conveyed from the image forming device 300 are received, a backside of the recording sheet 70 is glued to form a back gluing section 71, and the case cover 50 or 60 is bonded to the back gluing section 71 to carry out case bookbinding, whereby a desired book 80 is obtained. If the printing of the cover sheet display has been completed on the case cover by the offset printing or the like, transfer of the cover sheet display data, imposing and image formation on the case cover are omitted.

Hereinafter, the bookbinding process will be described more in detail by referring to a flowchart of FIG. 15. The flowchart shows an operation of the system which forms images on the text (book content data) and the case cover, and completes a case bound book. As a main body of the operation, the bookbinding system shown in FIGS. 5 to 10 is used. As a main body of determination, the image forming device control means 150 of the image forming device 100 side or the image forming device control means 350 of the image forming device 300 side, and the bookbinding device control means of the bookbinding device 200 side are used.

In the operation, though not shown in the flowchart, imposition is carried out when necessary before the process shown in the flowchart. In the case of directly forming an image on the recording sheet without imposing, the imposition may be omitted.

Figure 13:
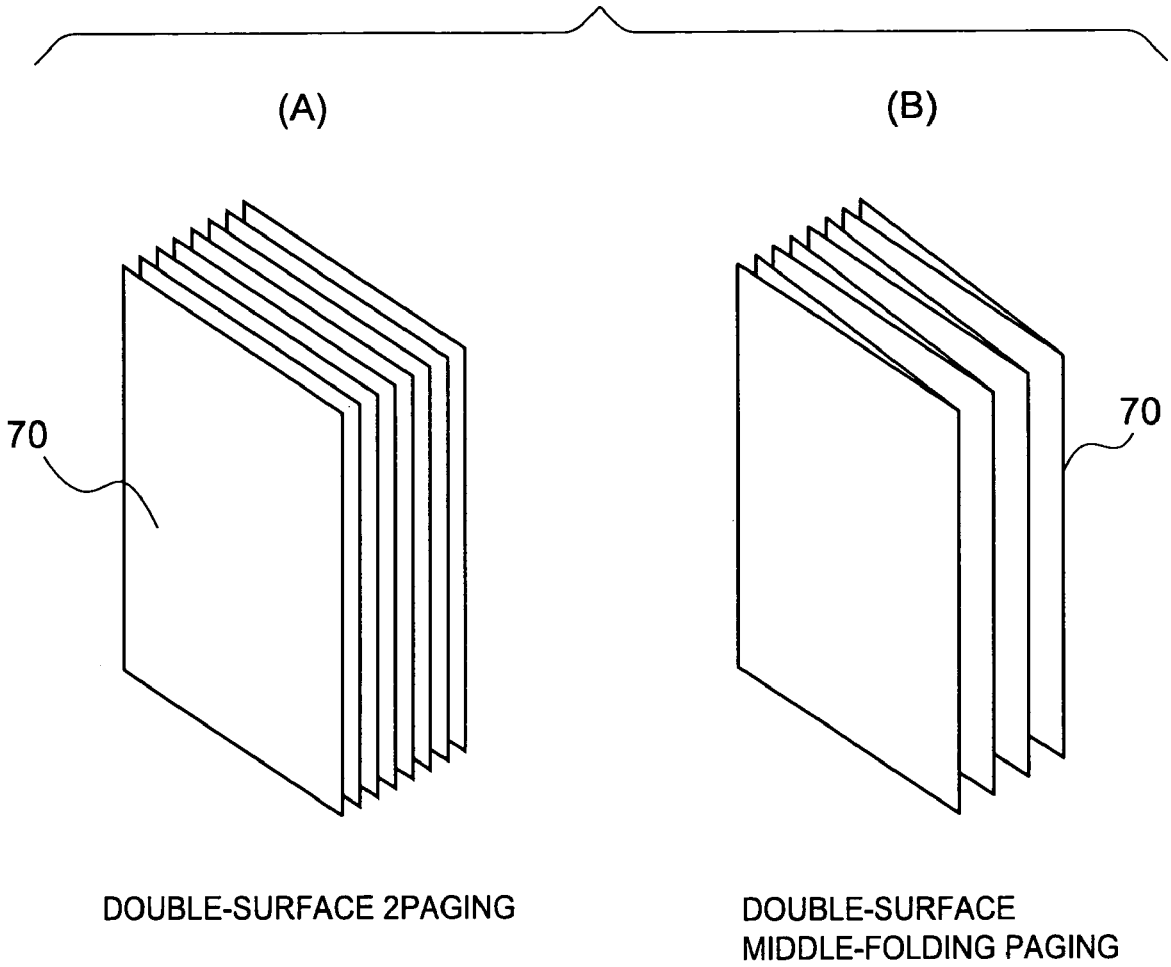
FIG. 13 illustrates imposition according to the present invention.
Figure 14:
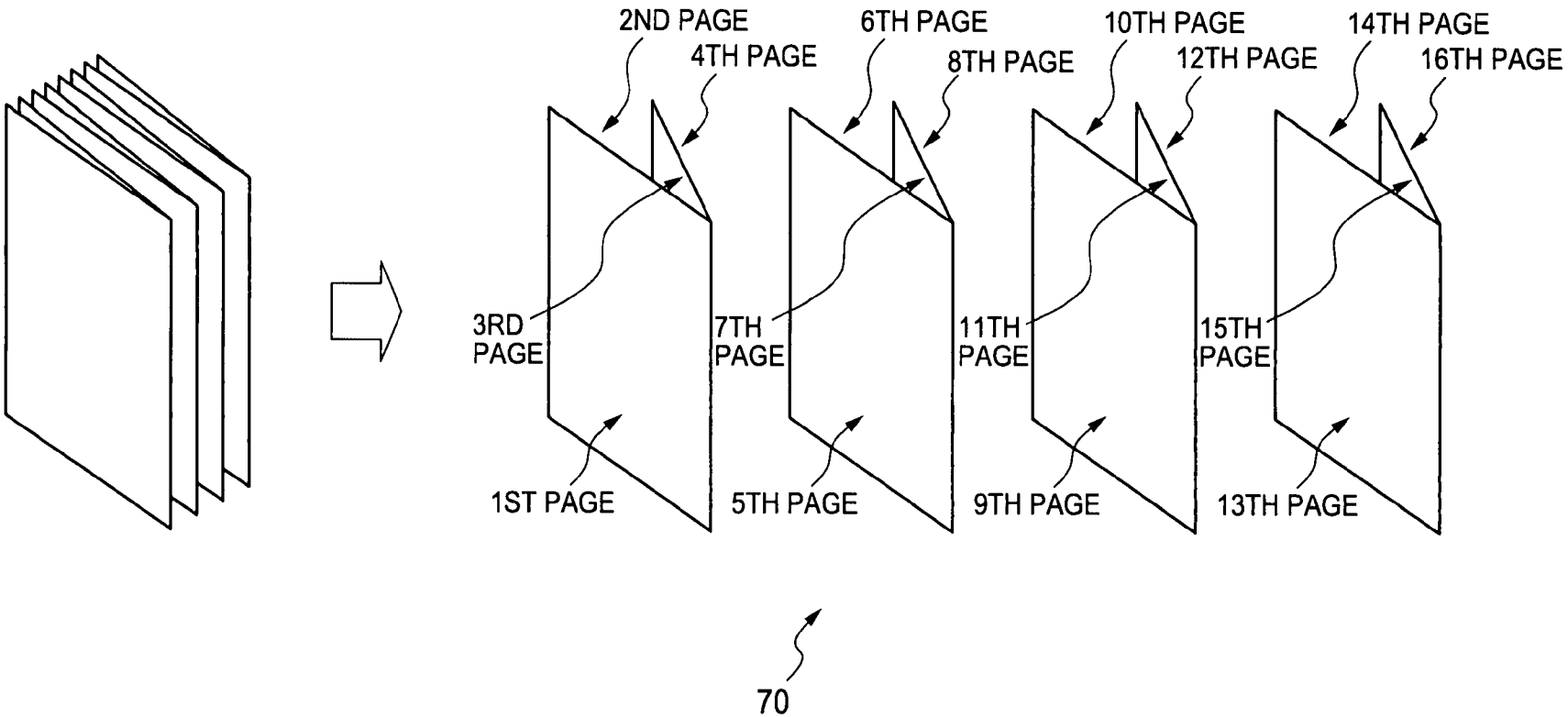
FIG. 14 is a view showing a relation of pages in the case of double-face center-folding layout 4 pages one sheet of paper.

FIG. 13 shows examples of imposing on recording sheets. The imposing means allocation of image data, which is carried out by the imposing means 103 of the image forming device 100 or the imposing means 303 of the image forming device 300. FIG. 13(A) shows a state of carrying out double-surface 2-imposing on the recording sheet 70, and FIG. 13(B) shows a case of double-face center-folding layout 4 pages one sheet of paper. In the case of the double-surface 2-imposing of FIG. 13(A), it is only necessary to align the recording sheet 70. On the other hand, in the case of double-face center-folding layout 4 pages one sheet of paper shown in FIG. 13(B), since four surfaces are formed by using the middle-folding means 207 (see FIG. 5) of the bookbinding device 200 to fold the recording sheet 70 at the middle, for printing on the sheet, the imposition is carried out so that pages can be positioned in a later-described middle-folded state as shown in FIG. 14. That is, four imposition is carried out so that a 4B+1-th page and a 4N+4-th page can be positioned on the outer surface side and a 4N+2-th page and a 4N+3-th page (N is an integer including 0) can be positioned on an inner surface side in the middle-folded state. Thus, when the sheet is folded at the middle by the middle-folding means 207, an image in which pages arrayed in good order can be formed. Therefore, ½ print costs can be realized compared with the case of simple double-surface printing.

Next, an operation after the imposition will be described by referring to the flowchart of FIG. 15. In this operation, when one image formation of the text (book content data) is completed, back gluing is executed, an image is formed on the case cover, and case processing is carried out. According to the invention, an image may be formed on the case cover first, and the process may be set on standby. When one image formation of the text (book content data) is completed, back gluing may be executed, and case processing may be carried out.

First, the bookbinding system 14 checks on whether one image formation of the text (book content data) has been completed or not (step S1). If not completed, the image formation must be continued. That is, a recording sheet is delivered from the recording sheet housing means 120 by the recording sheet feeding means 123 (step S2: first feeding), and a resist is deposited on the sheet to feed it to the image formation means 105 (step S3: second feeding). Then, at the image forming device 100, processing is carried out to form an image by the image formation means 105 based on the book content data stored in the book data memory means 102. In the case of using the image forming device 300, processing is carried out to form an image by the image formation means 305 based on the book content data stored in the book data memory means 302 (step S4).

Then, after the completion of the image formation, the recording sheet is conveyed to the bookbinding device 200 side by the pre-conveying means 140 or the recording sheet pre-conveying means 141. At the bookbinding device 200 side, the recording sheet is conveyed to the collection means 201 by the post-conveying means 220 or the recording sheet post-conveying means 221 (step S5), and collected by the collection means 201 (S6). The alignment means 202 aligns recording sheets thus collected by the collection means (step S7). Such an image formation process is repeated by the necessary number of times until one image formation is completed.

Then, upon the completion of one image formation of the text on the recording sheet, the process proceeds to case processing by a case cover. Though not shown in the flowchart, case cover alignment is carried out when necessary before the case processing. If a dedicated case cover is used as a case cover, and a size of the case cover exactly matches a size necessary for a cover sheet, etc., the alignment is not necessary.

Figure 16:
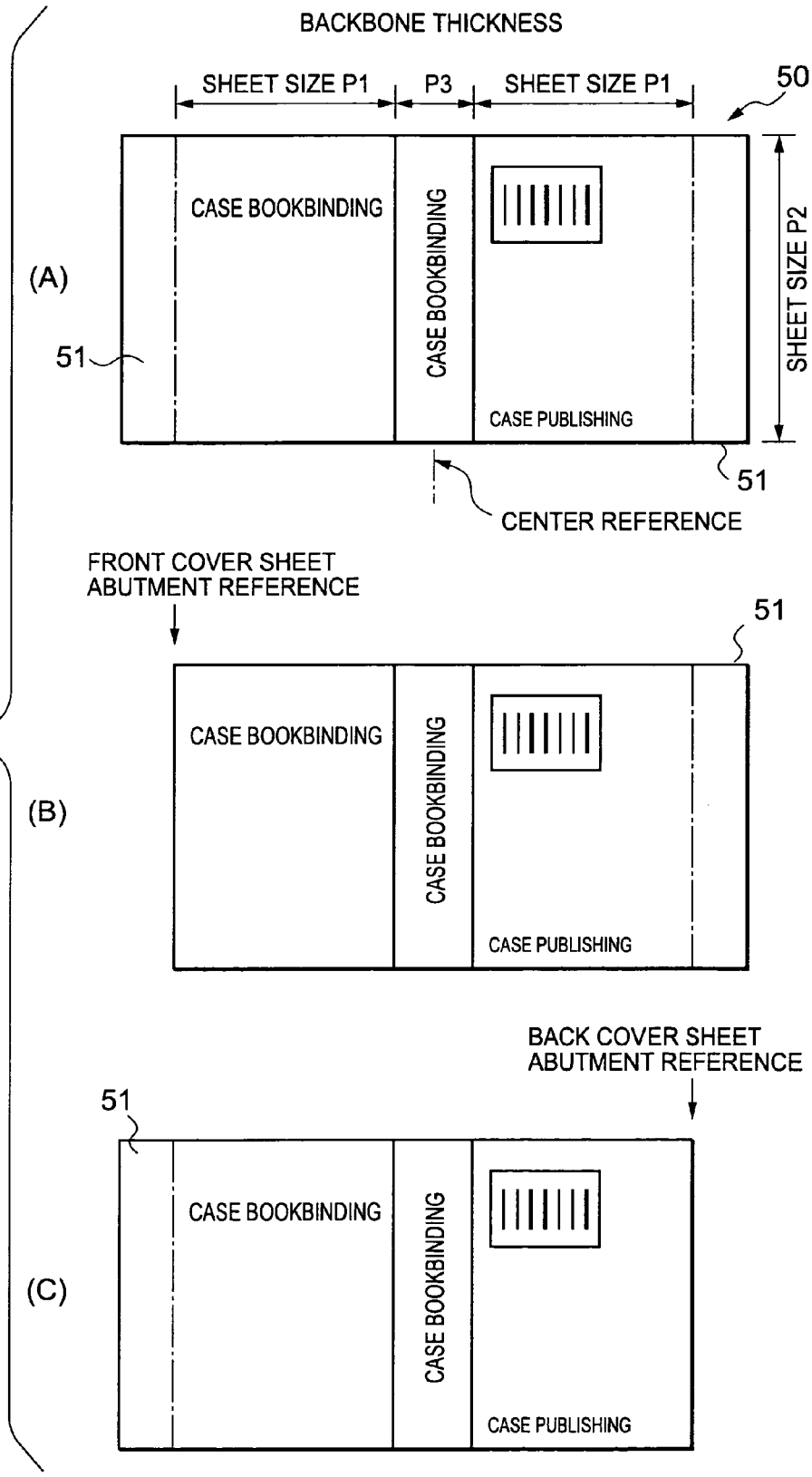
FIG. 16 illustrates case cover positioning.

FIG. 16 illustrates alignment of the case cover 50. FIG. 16(A) shows a case of alignment based on an image formation position center reference, and FIGS. 16(B) and 16(C) show a case of alignment based on image formation position abutment reference. Such alignment is carried out by the image formation positioning means 104 of the image forming device 100 or the image formation positioning means 304 of the image forming device 300. In the case of alignment of FIG. 16(A), it is carried out by setting the center of the cover sheet as a center reference. Thus, extra portions are fore-edge trims 51 protruded from the front and back cover sheets. These fore-edge trim portions are folded inside or cut by the cutting means 205 (see FIG. 5) of the later-described bookbinding device 200 to be adjusted, whereby an appearance is improved.

In the case of alignment of FIG. 16(B), a left end of the front cover sheet is set as a front cover sheet abutment reference. As a result, an extra portion is a fore-edge trim 51 of the back cover sheet. In this case, this fore-edge trim portion is cut by the cutting means 205 similarly to the above to be adjusted. In the case of alignment of FIG. 16(C), a right end of the back cover sheet is set as a back cover sheet abutment reference. As a result, an extra portion is a fore-edge trim 51 of the front covert sheet. In this case, this fore-edge trim portion is cut by the cutting means 205 to be adjusted.

Thus, based on a thickness of the back cover sheer or a sheet size, it is possible to realize a center reference positioning method or an abutment reference positioning method.

Figure 17:
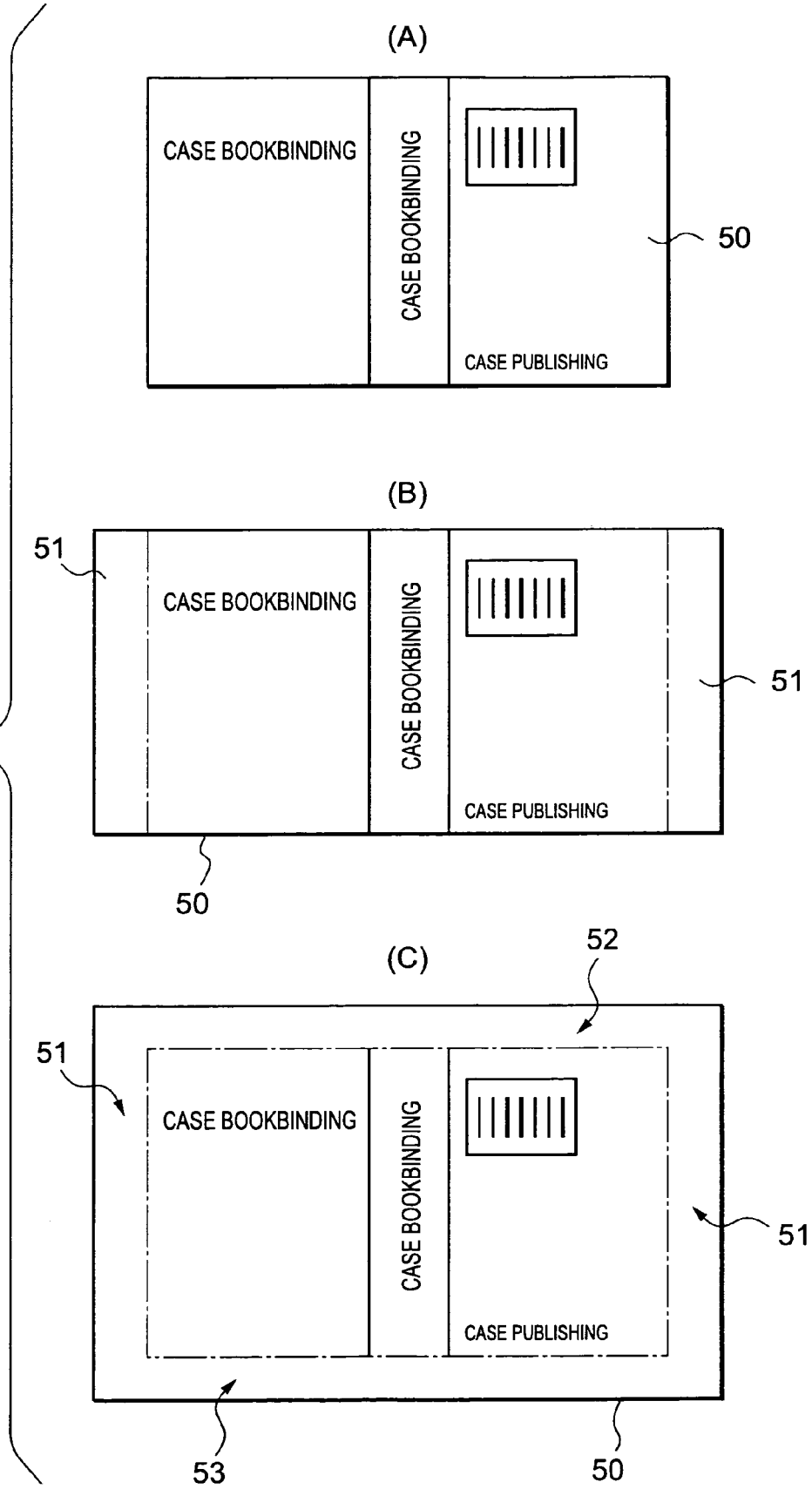
FIG. 17 illustrates unused portions after the case cover positioning.

Now, it is assumed that case cover sizes are P1, P2, and a back cover sheet thickness is P3 as shown in FIG. 16(A). In this case, a short side P2 of the case cover is equal in length to one side of a predetermined sheet size, and a long side is a length which is equal to the addition of a size twice as large as the other side (P1) of the predetermined sheet size and a thickness P3 of the back cover sheet. Thus, by managing the number of pages and kinds of paper, it is possible to obtain a case cover 50 of an exactly matching size in which a thickness of the back cover sheet is constant and cutting is unnecessary as shown in FIG. 17(A).

A front cover sheet area, a spine area and a back cover sheet area of the case cover can be set large as cover sheet display data. However, the spine area varies in thickness depending on a total thickness of recording sheets. Thus, it is possible to calculate the thickness of the spine based on the thickness data registered in the sheet thickness registration means 114, 314 and the data of the number of sheets counted by the collected sheet number counting means 241. This calculation is carried out by the bookbinding device control means 250.

In this way, the thickness of the set sheet can be registered for each feed tray, and the thickness of the spine can be surely known from the number of sheets on which images have been formed.

For example, if a sheet thickness is T and the number of sheets is K, a thickness of the spine becomes T×K, a thickness of the spine of the case cover can be calculated, and it is possible to easily allocate areas based on the thickness of the spine in the case of a center reference, an abutment reference.

Additionally, book page data is read from the book content data stored in the book data memory means 102, and a thickness of the spine can be calculated based on the thickness data registered in the sheet thickness registration means 114, 314. Thus, the thickness of the spine can be known early.

Figure 15:
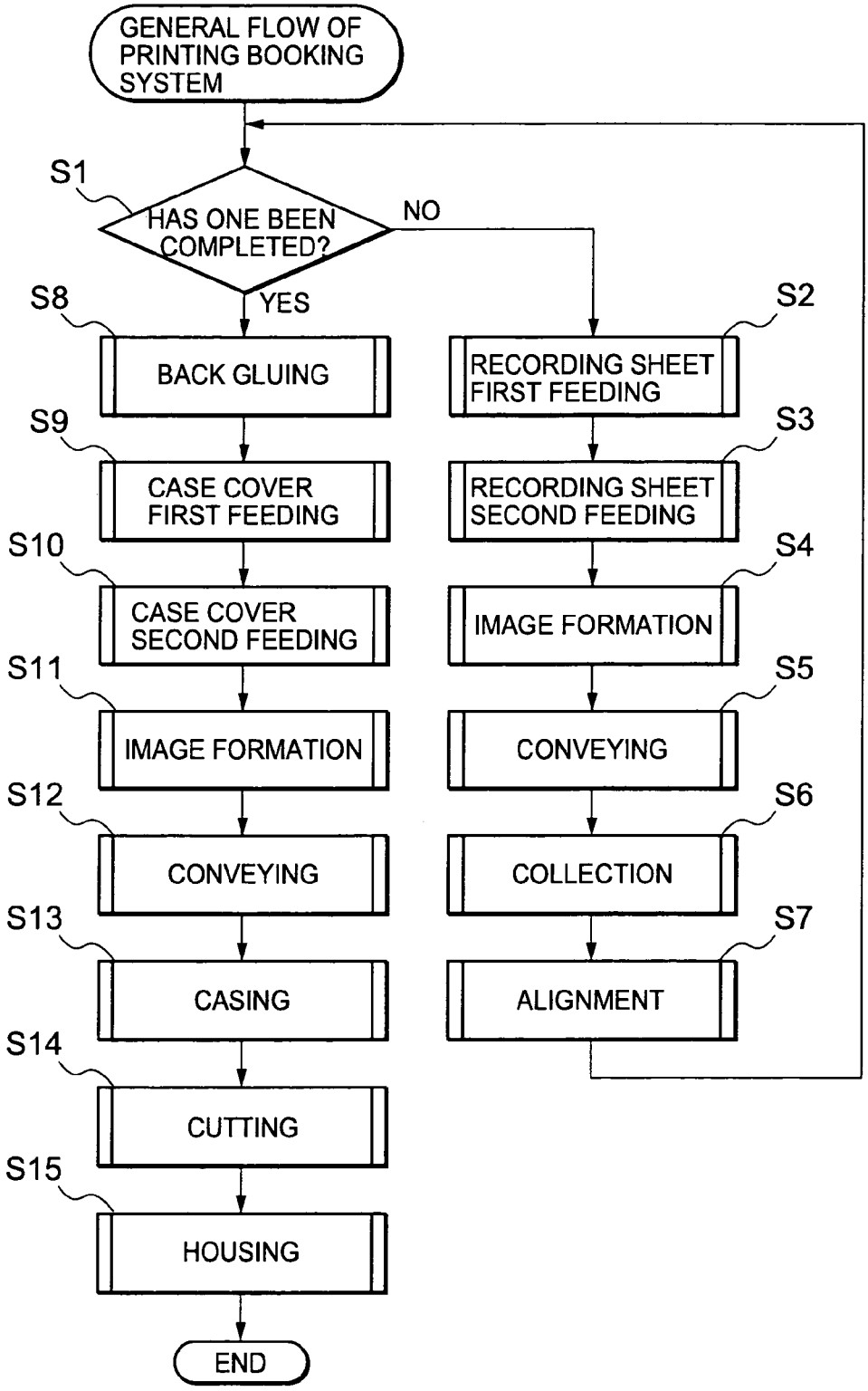
FIG. 15 is a flowchart showing an operation according to the present invention.

Then, to proceed to case processing, as shown in the flowchart of FIG. 15, back gluing is executed for the collected and aligned recording sheets (step S8). In the back gluing, as shown in FIG. 12(A), a backside portion of the collected and aligned recording sheet 70 is glued to form a back gluing section 71. In the case of folding the recording sheet at the middle, for example as shown in FIGS. 13(A) and 13(B), the recording sheet is folded at the middle by using the middle-folding means 207 of the bookbinding device 200 before the back gluing, and the back cover sheet portion of the middle-folded sheet is glued.

After the end of the back gluing, the bookbinding device control means 250 requests case cover preparation through the serial communication means 345, 245, 145 to the image forming device 100 or the image forming device 300. The image forming device control means 150 or 250 carries out image formation on the case cover as occasion demands.

First, first feeding is carried out to deliver the case cover housed in the case cover housing means 130 or 330 by the case cover feeding means 144 or 344 (step S9). Then, second feeding is carried out to deposit a resist on the cover case and feed it to the image formation section 105 or the image formation section 305 (step S10).

Image formation is carried out on the fed case cover by the image formation means 105, 305 (S11). In the image processing on the case cover, a cover sheet display is formed or added to the case cover. That is, if there is a predetermined print or image formed on the case cover, an image can be superposed on the predetermined print or image by image forming device 100, 300. Thus, it is possible to provide a system which forms an image on the case cover by superposing necessary items on the image offset printed or the like by a general-purpose design beforehand, and completes a case bound book.

If the image formation section 105 is a color printer, image formation on the recording sheet by one image formation section and image formation of a cover sheet display on the cover case can be carried out.

If the image formation section 105 is a monochromatic printer, the predetermined print or image can be formed by color printing or it can be a color print, and the image superposed thereon can be formed by monochromatic printing. Thus, it is possible to provide a system which prints intrinsic information by the monochromatic printer while a color print of a general-purpose design is used as a base.

If the system comprises the image formation section 105 and the image formation section 305, roles can be shared to carry out image formation on the recording sheet by the image formation section 105 and image formation of a front cover sheet on the case cover by the image formation section 305.

Here, "printing" means image formation by offset printing or the like, and "print" means image formation by an electrophotograph.

The image formed on the case cover can contain at least one of a book title, an author's name, a publication place (publishing company), a price, a bookstore's name, and barcode information. Thus, necessary information among the book title, the author's name, the publishing house (publishing company), the price, the bookstore's name and the barcode information can be superposed and printed. Not only the necessary information but also the intrinsic information can be printed to complete a book of purchaser's own. In this case, the intrinsic information can be at least one of an address of the purchaser, a name, a message and a purchase date. Accordingly, it is possible to print not only a name of an opposite to whom a gift is presented and a date but also a message to be communicated as intrinsic information on the cover sheet.

The case cover on which the image formation has been carried out in the foregoing manner is conveyed to the bookbinding device 200 side by the pre-conveying means 140 or the case cover pre-conveying means 340 and, from the bookbinding device 200 side, it is conveyed to the casing means 204 by the post-conveying means 220 or the case cover post-conveying means 221 (step S12). Then, at the casing means 205, casing is carried out in which the conveyed case cover is pressed to the back gluing section of the recording sheet 70 which has been back-glued beforehand, and cased (step S13).

After the end of the casing, a book appearance is completed. Thus, at the cutting means 205, for example, an unnecessary portion such as a fore-edge trim is cut to improve the appearance of a book (step S14). At this time, the appearance of the bound book can be improved more by cutting a text (book content data) (cutting together). If image imposing is carried out on the recording sheet, and the sheet is folded at the middle, necessary middle-folding is carried out by the middle-folding means 107 before the cutting.

In the cutting, as shown in FIGS. 16(A) and 17(B), if a short side P2 of the case cover is equal to one side of a predetermine sheet size, and a long side is longer than the addition of a size twice as large as the other side P1 of the predetermined sheet size and a thickness P3 of the spine, a portion (fore-edge trim 51) protruded from the recording sheet size is cut by the cutting means 205.

As shown in FIGS. 16(A) and 17(C), of a short side P2 of the case cover is longer than one side of the predetermined sheet size, and a long side is longer than the addition of a size twice as large as the other side P1 of the predetermined sheet size and a thickness P3 of the spine, and has extra portions on three sides, the three portions protruded from the recording sheet size are cut by the cutting means 205. Here, the three sides mean a fore-edge trim 51, a top 52 and a bottom 53.

Accordingly, it is possible to improve the appearance of the three sides by cutting the portions protruded on the three sides. Additionally, in this case, the appearance can be improved more by cutting (cutting together) the text (book content data).

A case cover in which cutting is unnecessary can be completed by using not-shown middle-folding means to fold the portion of the case cover protruded from the recording sheet size to the inside.

The bound book completed in the foregoing manner is housed by the bound book housing means 206 (step S15). Then, the bookbinding completion counting means 240 updates a count by 1, and notifies this (count information and information specifying the book) to the management server 5 through the network 6.

In the management server 5, the main control section 30 starts the charging section 36 to carry out charging based on the book specifying information and the count information, and erases the book content data temporarily stored in the memory section 32.

The bound book is handed to a customer, and the customer pays for the book. The money for the book may be paid on the spot. Alternatively, charging information may be accumulated in the management server 5, and payment for the book can be settled with the bookstore at, for example, the end of a month.

According to each of the embodiments, it is optionally decided whether the image formation on the recording sheet and the image formation on the case cover are carried out by a common image formation section or different image formation sections. For example, the image is formed on the case cover by a color printer, while the image is formed on the recording sheet by a monochromatic printer. The sheets on which the images have been formed can be conveyed in-line to the bookbinding device. In addition, only one may be conveyed in-line to the bookbinding device. For example, the case cover on which the image has been formed by the color printer is housed in the case cover housing means, while the recording sheet on which the image has been formed by the monochromatic printer is conveyed in-line to the bookbinding device.

The embodiment has been described by way of case in which the image is formed on the case cover by the image forming device lob or the image forming device 300. However, the present invention is not limited to this case. An image may be formed on the case cover beforehand by offset printing or the like, and the sheet can be cased by this case covet. This will be specifically described hereinafter.

Figure 18:
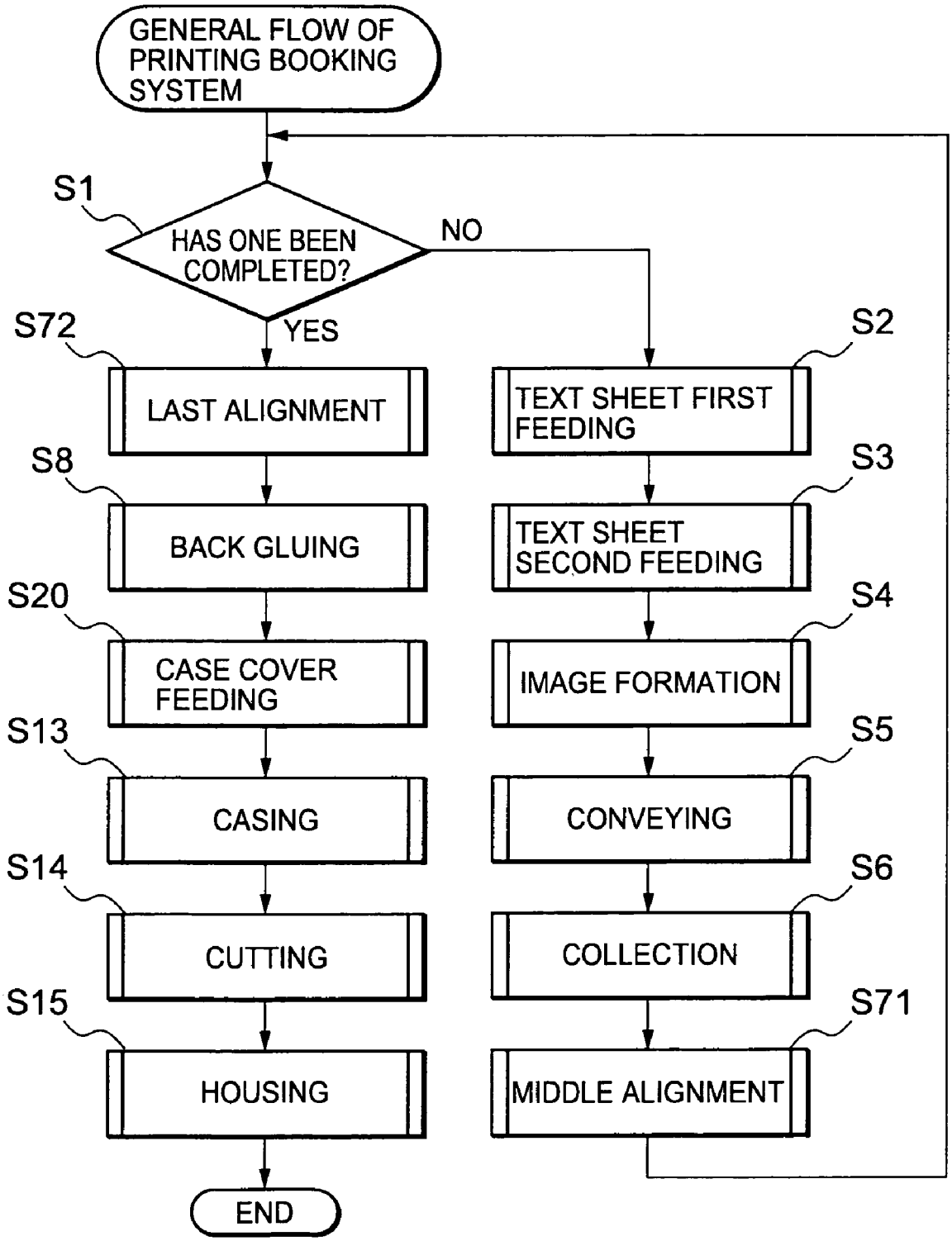
FIG. 18 is a flowchart showing a second operation according to the present invention.

FIG. 18 is a flowchart showing a process of case bookbinding carried out without forming any images on the case cover. According to the embodiment, an image is formed on the text (book content data), the case cover is directly housed in the case cover housing means 230 of the bookbinding device 200 side without being passed through the image forming device 100, and conveyed to complete a case bound book. According to the embodiment, in alignment, alignment conditions are changed between middle alignment (S71) and last alignment (S72), and more time is expended especially for the last alignment to improve back gluing accuracy of a next step.

The case cover is housed in the case cover housing means 230 as described above. Then, in step S20, when a feeding command is received from the bookbinding device control means 250, the case cover is delivered by the case cover feeding conveying means 234, and conveyed to the casing means 204. Other steps similar to those of FIG. 15 are denoted by similar reference numerals, and description thereof will be omitted.

Figure 19:
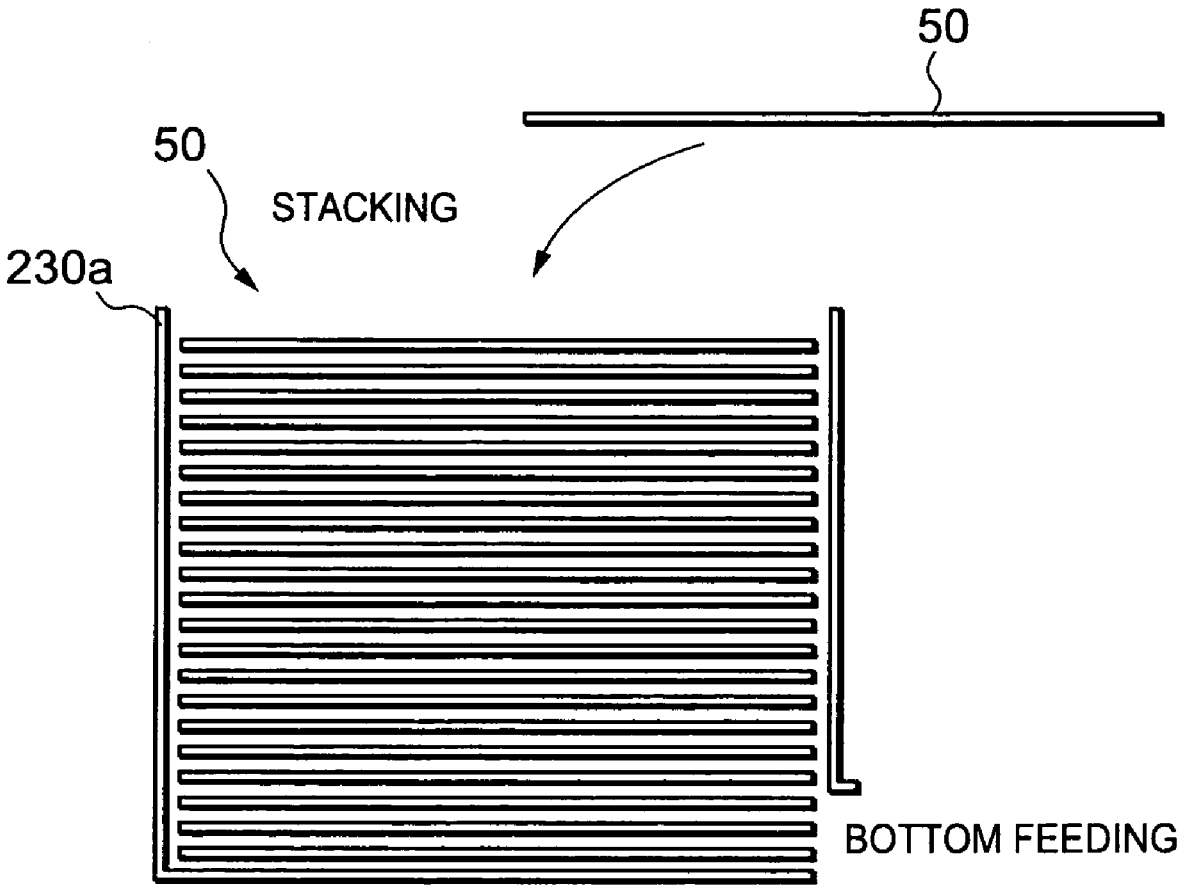
FIG. 19 is a view illustrating stacking/bottom feeding system of case housing means.

For the case cover housing means 230, as shown in FIG. 19, a staking/bottom feeding system is preferably used. In the feed tray 230*a* of the case cover housing means 230, case covers 50 are sequentially stacked from above. Then, the case covers 50 are sent out from the bottom of the tray 230*a*. Thus, top stacking/top feeding is set, and book content data and the case covers 50 are correlated in order. The stacking/bottom feeding system can be applied to the case cover housing means 130.

According to each of the embodiments, a process for controlling based on case cover presence detection and size detection can be included if desired. In the process of FIG. 18, for example, it can be included in the image formation (step S4) to be executed. Hereinafter, this process will be described in detail.

In this control process, presence of a case cover is detected by the case cover presence detection means 231 disposed in the case cover housing means 230. A size of the case cover is detected by the case cover size detection means disposed in the case cover housing means 230. Accordingly, it is possible to detect the case cover presence and the case cover size. In the execution of the detection, the housing means of a case cover to be fed for bookbinding becomes a target.

Figure 20:
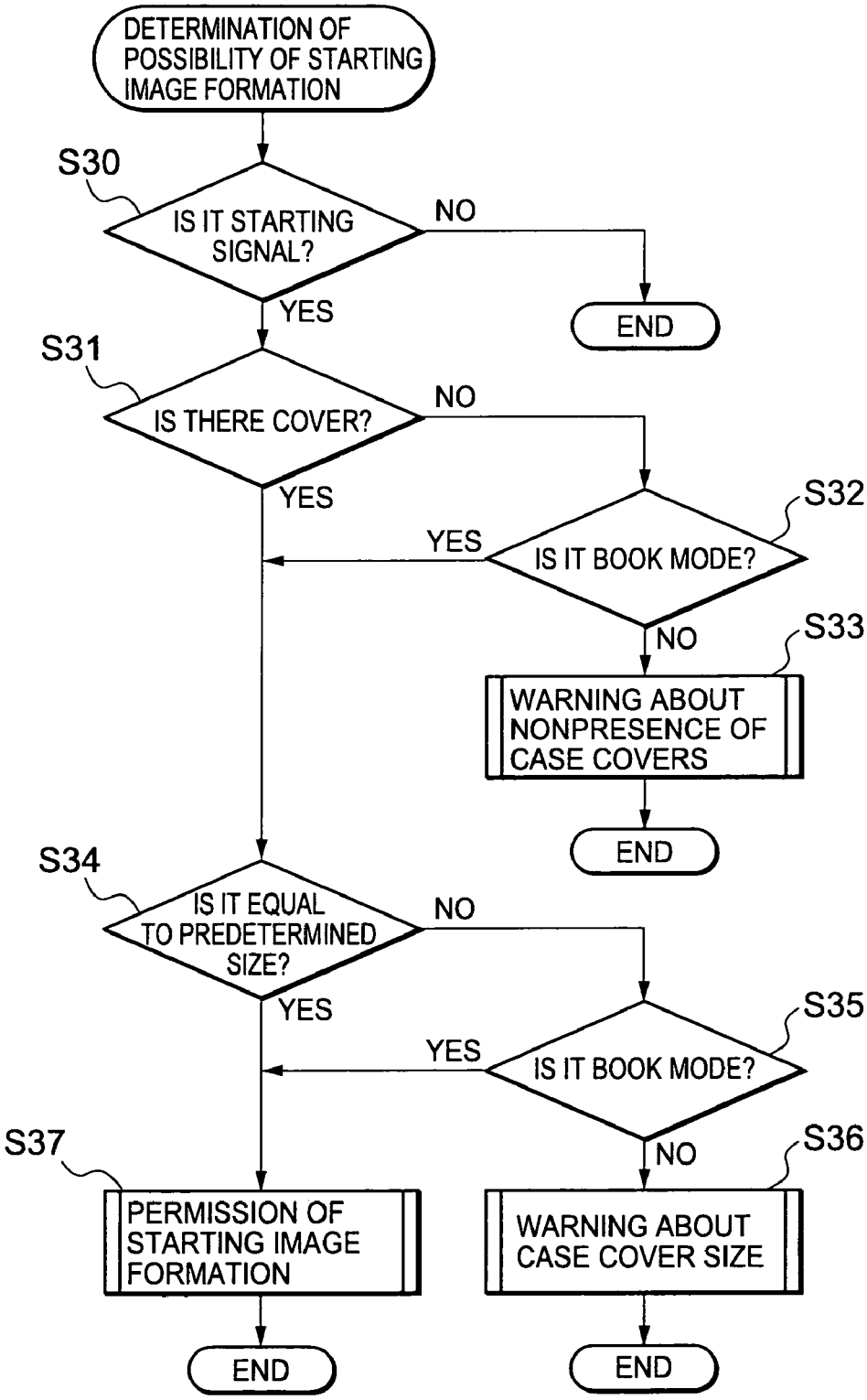
FIG. 20 is a flowchart showing determination of a possibility of starting image formation in the case of no case covers or a size other than a predetermined size.

FIG. 20 is a flowchart showing determination of possibility of starting image formation in the case of no case covers or a size other than a predetermined size. According to the embodiment, starting of image formation is permitted on a book mode even if the case cover presence detection means detects no case covers, or the case cover size detection means detects a size other than a predetermined size. A main body of the determination is the image forming device control means 150 or the image forming device control means 350.

First, checking is made on whether an image formation starting signal has been entered or not (S30). The image formation starting signal is issued from the image forming device control means 150 or 250.

If the starting signal has been entered, the case cover presence detection means checks on where there is a case cover or not (S31). If there are no case covers, checking is made on whether a mode is a book mode or not (S32). If the mode is a book mode, the process returns to a sequence similar to that when there is a case cover even if there are no case covers, and proceeds to later-described step S34. Here, the book mode means a mode for making a book. In this case, since the case cover may be color-printed by another printer, image formation of the text (book content data) must be carried out even if there are no case covers.

If it is determined in step S32 that the mode is not a book mode, nonpresence of case covers is warned to finish the determination of the possibility of starting the image formation. The mode of warding can be realized by notification which uses one of displaying of a message or an icon on an operation panel of the bookbinding system, sounding of a buzzer in the bookbinding system, voice guiding from the speaker in the bookbinding system, rotation of a patlight on the bookbinding system, and notification by electronic mail from the bookbinding system to manager's personal computer.

In step S34, if the mode is a book mode irrespective of presence of case covers or nonpresence of case covers, checking is made on whether the case cover is equal to a predetermined size or not (S34). If the case cover is not equal to the predetermined size, checking is made on whether the mode is a book mode or not (S35). If the mode is a book mode, the process returns to the image formation mode, and proceeds to step S37. If the mode is not a book mode, warning is issued about the case cover size (S36) to finish the determination of the possibility of starting the image formation. The warning in step S36 can be carried out by notification similar to the above. In step S37, starting of image formation is permitted.

According to the present invention, even if the case cover presence detection means detects no case covers, the image formation starting of the book content data can be permitted if the mode is a book mode. Thus, a control method which permits the image formation of the book content data even if there are no case covers set beforehand in the housing means can be provided to deal with the case of staring printing by different printers, e.g., printing of the text (book content data) by the monochromatic printer and printing of the case cover by the color printer.

According to the present invention, even if the case cover size detection means detects a size other than the predetermined size, the image formation starting of the book content data can be permitted if the mode is a book mode. Thus, even if a different case cover is set, since the image formation can be started, the image formation starting of the book content data can be permitted. After the start of the image formation, feeding of the case cover is stopped if nonpresence of case covers or a case cover size other than the predetermined size is detected.

Moreover, according to each of the embodiments, if desired, after the conveying, the collection and the alignment (steps S5 to S7), a process for controlling carried out beforehand based on case cover presence detection, size detection and identification information reading can be included in the back gluing (step S8).

By this control process, even if there is no proper case cover housed in the housing means, control can be carried out to prevent starting of back gluing. Hereinafter, this process will be described in detail.

Figure 21:
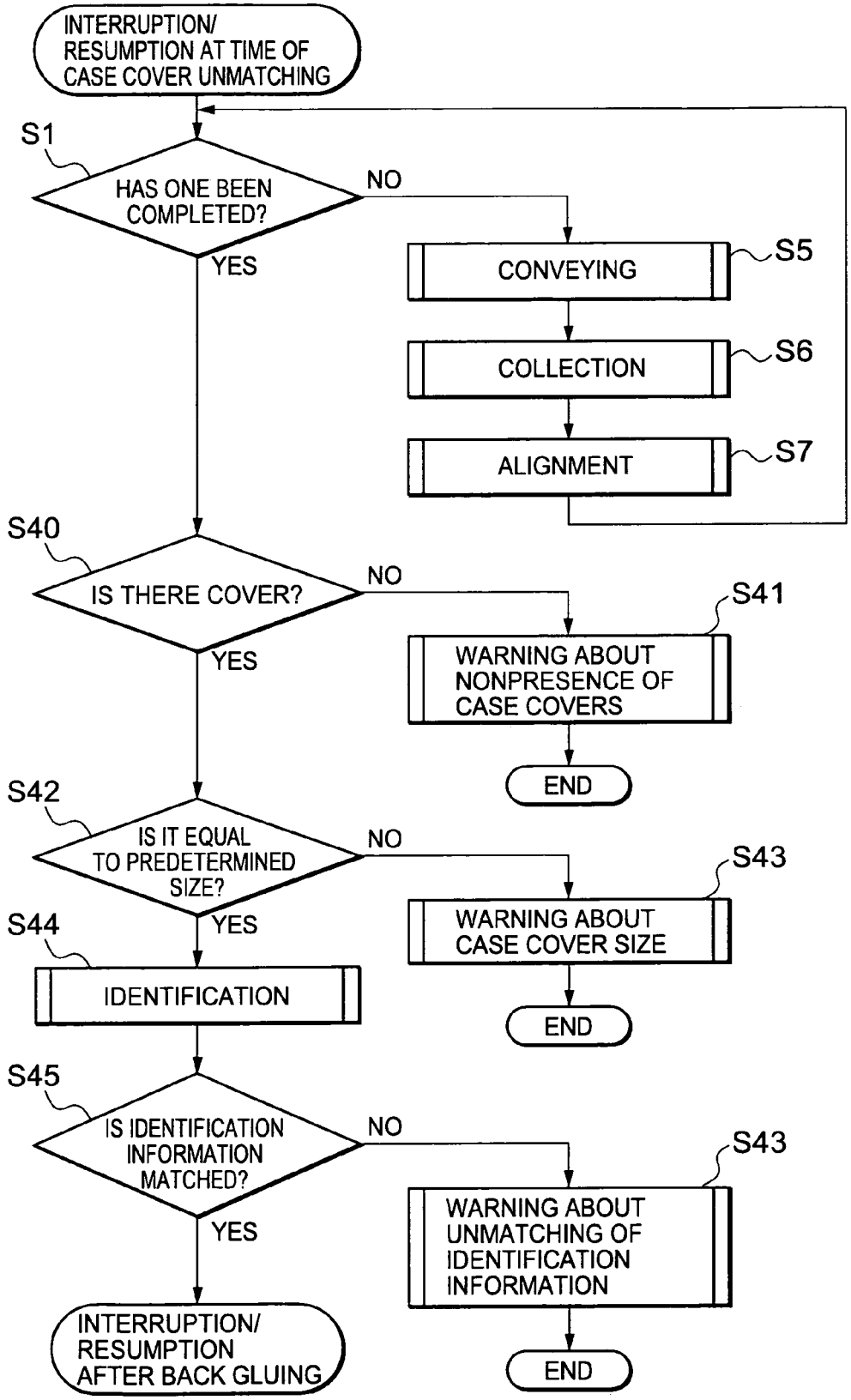
FIG. 21 is a flowchart showing an interruption/starting process in the case of no case covers, a size other than a predetermined size or unmatched identification information.

FIG. 21 is a flowchart showing interruption/resumption processing in the case of no case covers, a size other than a predetermined size or identification information unmatching. Processing steps similar to those of the aforementioned embodiment are denoted by similar step numerals, and description thereof will be omitted or simplified.

First, checking is made on whether formation of one text (book content data) has been completed or not (S1). If one text (book content data) formation has been completed, checking is made by the case cover presence detection means on whether there is a case cover or not (step S40). If there are no case covers, warning is issued about nonpresence of case covers (step S41). The mode of warding can be realized, as described above, by notification which uses one of displaying of a message or an icon on an operation panel of the bookbinding system, sounding of a buzzer in the bookbinding system, voice guiding from the speaker in the bookbinding system, rotation of a patlight on the bookbinding system, and notification by electronic mail from the bookbinding system to manager's personal computer. If nonpresence of case covers is detected, proceeding to the back gluing is stopped.

If it is determined in step S40 that there is a case cover, the case cover size detection means detects a size of the case cover. Then, checking is made on whether the case cover is equal to a predetermined size or not (S42). If the case cover does not match the predetermined size, then warning is issued about the case cover size (S43). The mode of warning is similar to the above. When the size of the case cover other than the predetermined size is detected, proceeding to the back gluing is stopped.

If it is determined in step S42 that the case cover size is equal to the predetermined size, identification processing is carried out (S44). In the identification processing, identification information (e.g., ID information or barcode information) is printed on the case cover. Then, the identification is read by reading means (e.g., CCD) 133, 233 or 333, and compared with the identification information of the book content data. That is, the identification processing is carried out to verify that it is a case cover for the book. Then, checking is made on the matching of the identification information (S45). If the identification information is not matched, warning is issued about the unmatching of the identification information (S46). The mode of warning is similar to the foregoing. In the case of unmatching of the identification information, proceeding to the back gluing is stopped.

In the process thus far, after the completion of one round of conveying, collection and alignment, determination is made on whether there is a case cover or not, the size is equal to a predetermined size or not, and the identification information matches the identification information of the book or not before the back gluing is started. After verification of matching of the identification information in step S45, the process proceeds to the back gluing (step S8).

If nonpresence of case covers is detected, the case cover size other than the predetermined size is detected, and the unmatched state of the identification information is detected, the case cover is replaced by another or the like to realize detection of presence of a case cover, detection of equality of the case cover size to the predetermined size, and detection of the matched state of the identification information. Then, the above processing can be continued.

Then, according to each of the embodiments, after the completion of the back gluing (step S8), a process for controlling detection of presence of case covers, size detection and identification information reading can be included before case cover feeding (steps S9, S10). By this control process, in a state in which no proper case covers are housed in the housing means, control can be carried out to prevent starting of casing even if back gluing has been executed. Hereinafter, this process will be described in detail.

Figure 22:
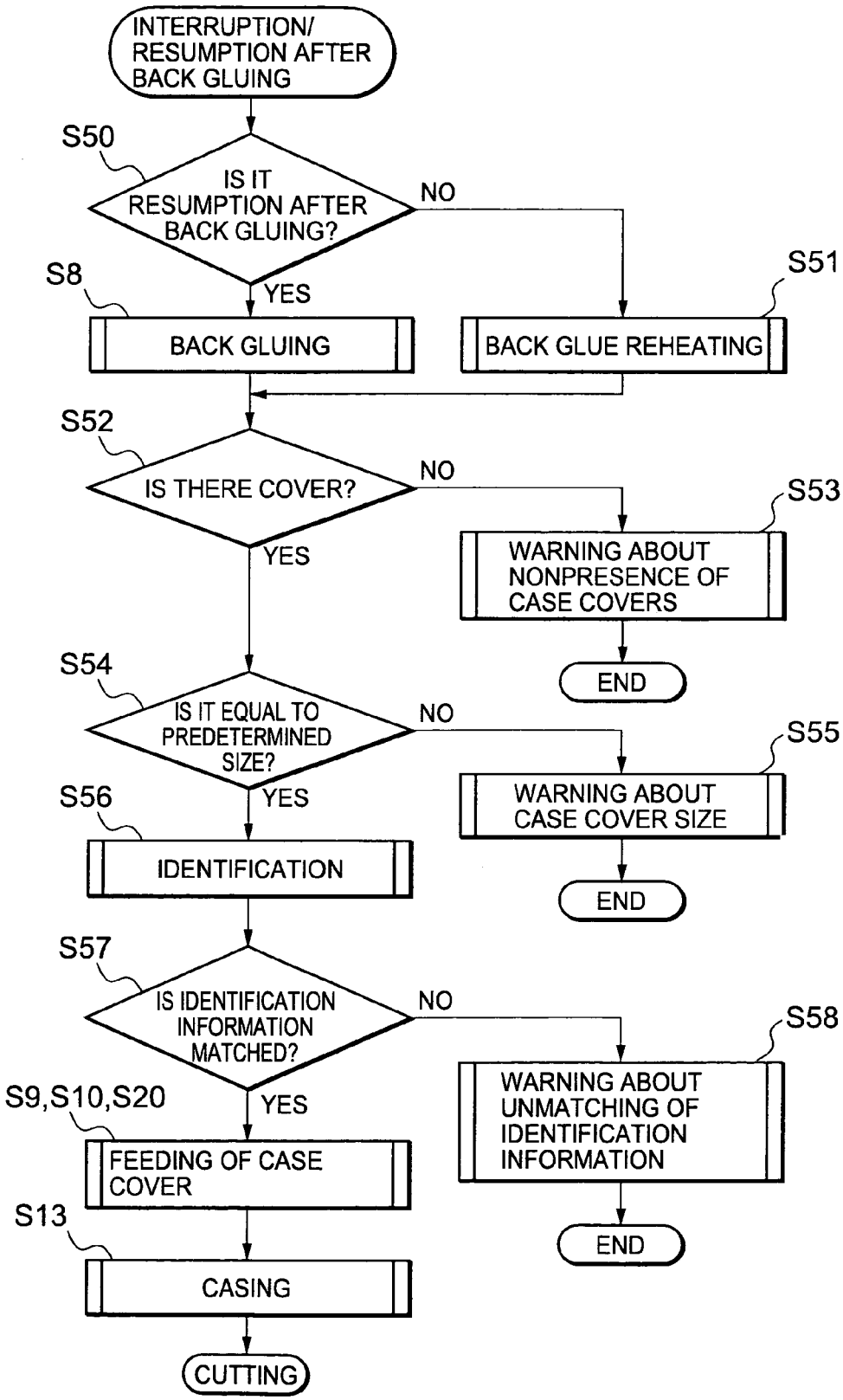
FIG. 22 is a flowchart showing an interruption/resumption process in the case of no case covers, a size other than s predetermined size or unmatched identification information.

As shown in FIG. 22, before the back gluing (step S8), checking is made on whether the back gluing has been resumed or not (S50). At a point of time when the back gluing is carried out, there may be no more caver cases. For example, the case cover may be pulled out for one reason or another. In this case, the operation of the bookbinding system is temporarily stopped. At this time, a new case cover must be conveyed. If it is determined in step S50 that the back gluing has been resumed, back glue reheating is carried out to melt the glue (S51). Subsequently, the process proceeds to step S52 as in the case of no resumption of back gluing. If it is determined in step S50 that the back gluing has not been resumed, back gluing is carried out (S8).

After the end of the gluing or the melting of the glue by heating, checking is made by the case cover presence detection means on whether there is a case cover or not (S52). If there are no case covers, warning is issued about nonpresence of case covers (S53). Warning notification can be carried out similarly to the foregoing other warnings.

If it is determined in step S52 that there is a case cover, in next step, checking is made by the case cover size detection means on whether the case cover size is equal to a predetermined size or not (S54).

If the size is not equal to the predetermined size, warning is issued about the case cover size (S55). Warning notification is similar to the above. If the size is equal to the predetermined size, then identification processing is carried out (S56). This identification processing is carried out by identification information reading means (e.g., CCD) and, similarly to the aforementioned identification processing, determination is made on matching of the case cover with the text (book content data). Then, checking is made on matching of identification information (S57). If unmatching is determined, warning is issued about the unmatching of the identification information (S58). Warning notification is similar to the above. If matching is determined, the case cover is fed (steps S9, S10 or S20). In the process thus far, after completion of back gluing or back glue reheating, before starting of casing, determination is made on presence of case covers, equality of a size to a predetermined size, and matching of the identification information.

Figure 23:
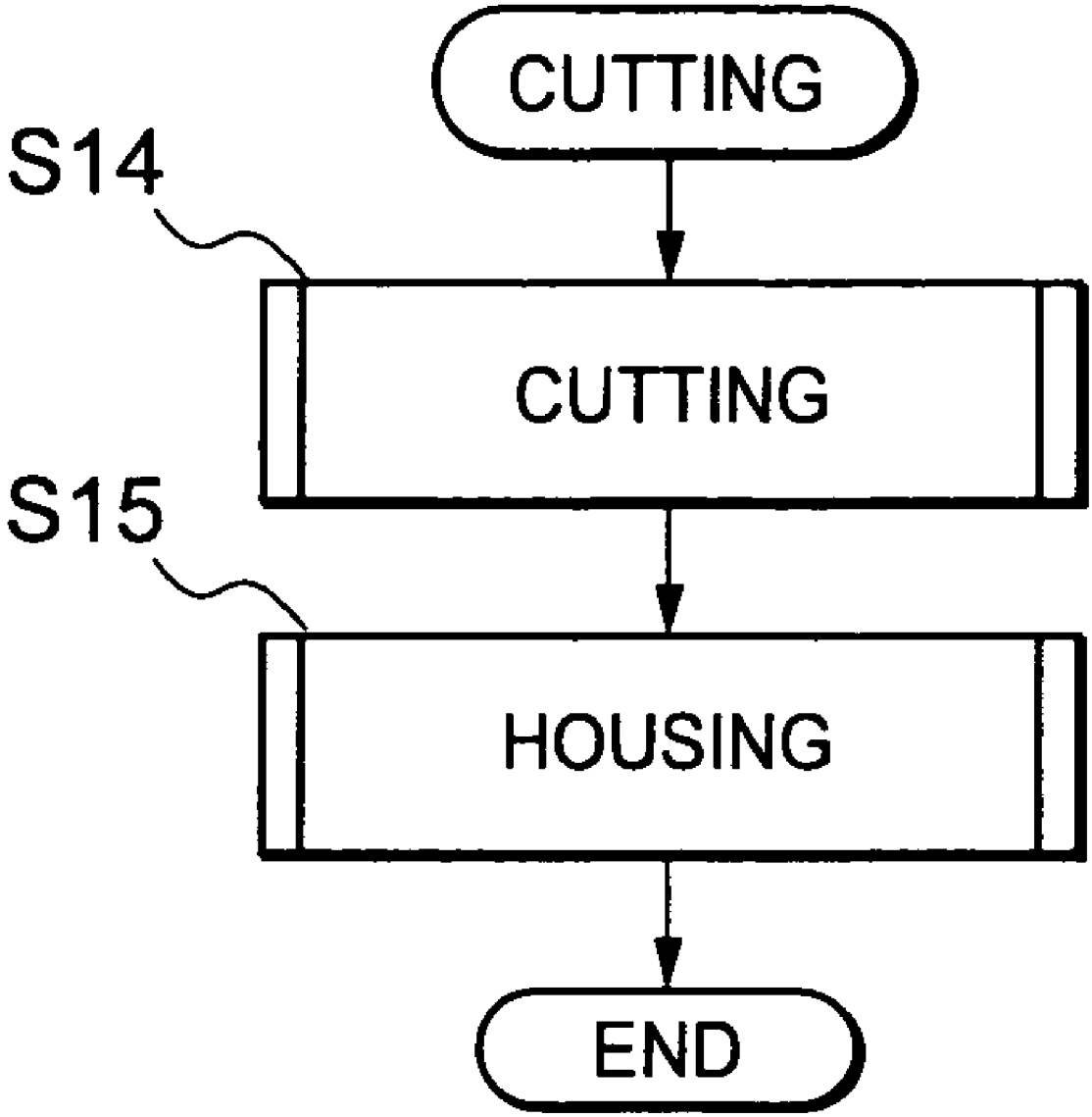
FIG. 23 is a flowchart showing a sheet cutting process.

Then, as in the case of the aforementioned embodiment, casing is carried out by the casing means 204 (S13). When necessary, as shown in FIG. 23, cutting is carried out by the cutting means 206, and the book improved for appearance by cutting (cutting together) the text (book content data) is housed in the housing means 206 (S15).

Thus, the identification information is printed on the case cover, the identification information is read by the reading device, compared with the identification information of the book content data, and a casing step can be executed in accordance with a result of the comparison.

According to the present invention, after completion of the operation of bask-gluing the predetermined number of aligned sheets, when the case cover presence detection means detects nonpresence of case covers, the case cover size detection means detects a size other than the predetermined size, or the unmatching of the identification information of the case cover is detected, the casing operation is not started. Then, when the case cover presence detection means detects presence of a case cover, the case cover size detection means detects a size equal to the predetermined size, and the matching of the identification information of the case cover is detected, the bookbinding device control means 250 can start the casing operation after the hardened glue of the back gluing section 71 is heated to melt.

Accordingly, if no case covers are set on the predetermined feeder after the execution of the back gluing, the operation is temporarily stopped, and the casing operation can be executed after heating the hardened glue to melt after resumption.

Moreover, in the identification processing of the embodiment, if the unmatching of the identification information of the case cover is detected, searching of a case cover and changing from a dedicated case cover to a general-purpose cover can be carried out. Hereinafter, this process will be described.

Figure 24:
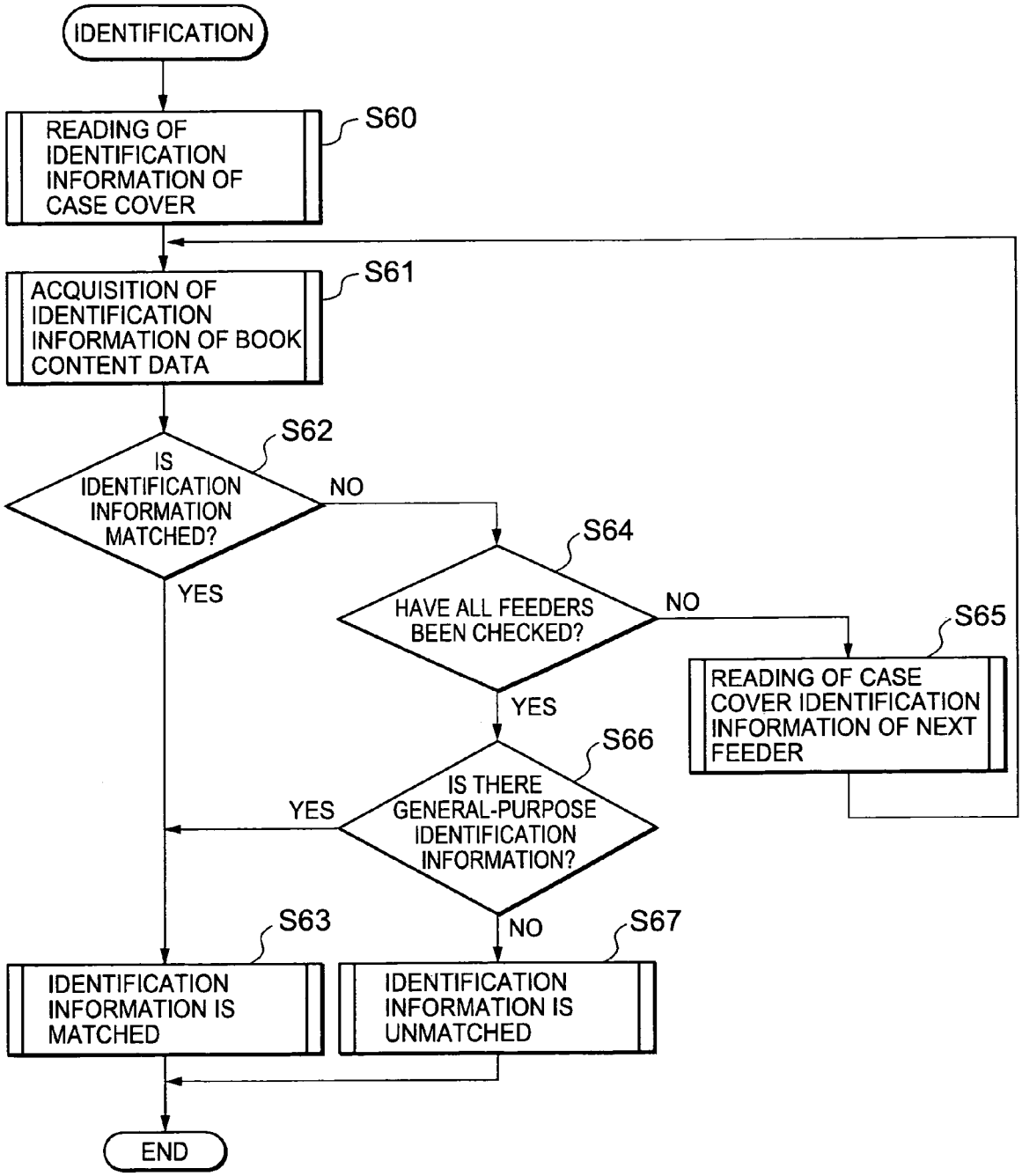
FIG. 24 is a flowchart showing an identification process.

FIG. 24 is a flowchart showing the identification processing. A main body of determination is the image forming device control means 150, the image forming device control means 350, or the bookbinding device control means 250. In this case, first, identification information of a case cover (e.g., ID information or barcode information) is read by the identification information reading means (e.g., CCD) (S60).

Then, identification information of book content data is obtained from the book content data (S61). Then, checking is made on matching of the identification information of the case cover with that of the book content data (S62). If the matching of the identification information with the other is determined, the process understands the identification information matching to proceed to next processing (S63).

If unmatching of the identification information with the other is determined in step S62, checking is made on whether identification information of all the housing means which house case covers have been checked or not (S64). If the checking of all the feeders has not been finished, case cover identification information of next housing means is read (S65), and the process returns to step S61 to repeat verification of unmatching. If the cover identification information of all the housing means has been verified in step S64, there are no covers of matched identification information. In this case, checking is made on whether the read identification information of each housing means contains general-purpose identification information or not (S67).

If there is general-purpose identification information, the process understands identification information matching to execute matching processing (S63). If there is no general-purpose identification information, identification information unmatching is verified (S67).

Thus, if the case cover feeder is a multitray, feeders are sequentially searched to enable selection of a feeder in which a case cover of matched identification information is set. If there is no matched identification information, as long as there is a case cover which is general-purpose identification information (almighty), the case cover can be selected to execute a casing step.

As described above, among the aspects of the present invention, according to the bookbinding system of the first aspect of the present invention, the system includes a book content data input section to which book content data regarding a content of a book is entered, a cover sheet data input section to which cover sheet data regarding a cover sheet display is entered, a book content image formation section which forms images on recording sheets based on the book content data entered from the book content data input section, a cover sheet display image formation section which forms an image on a case cover based on the cover sheet data entered from the cover sheet data input section, back gluing means for back-gluing the recording sheets on which the images have been formed, and casing means for casing the recording sheets back-glued by the back gluing means with a case cover to bond the sheets. Thus, by using the book content data and the cover sheet display data, the process from image formation to glued bookbinding can be carried out in-line, and a bookbinding system suited as a book on-demand system can be constructed.

According to the bookbinding system of the sixth aspect of the present invention, a part of a cover sheet display is printed or an image is formed on the case cover before the case cover is housed in the case cover housing means, and the cover sheet display image formation section superposes an image of the other cover sheet display on the case cover. Thus, intrinsic information or the like can be included later in the case cover on which a print has been made by a general-purpose design.

According to the bookbinding system of the thirteenth aspect of the present invention, the system includes a book content data input section to which book content data regarding a content of a book is entered, a book content image formation section which forms images on recording sheets based on the book content data entered from the book content data input section, case cover housing means for housing a case cover on which cover sheet display has been printed or an image has been formed, back gluing means for back-gluing the recording sheets on which the images have been formed, and casing means for casing the recording sheets back-glued by the back gluing means with a case cover to bond the sheets. Thus, by using a predetermined print,even using a printed case cover or a case cover of a predetermined thickness which cannot be passed through the image formation section, it is possible to construct a bookbinding system as a book on-demand system which can carry out the process from image formation to glued bookbinding in-line.

According to the bookbinding system of the thirty-first aspect Of the present invention, cover identification information is imparted to the case cover corresponding to content identification information held by the book content data, identification information reading means is provided for reading identification information of the case cover housed in the case cover housing means, and feeding possibility determination means is provided for enabling feeding of the case cover when the cover identification information is read by the identification information reading means, and compared with the content identification information, and in accordance with a result of the comparison it is determined whether the cover identification information corresponds to the content identification information.

What is claimed is:

1. A bookbinding system comprising:

an image forming device; and a bookbinding device which is coupled to the image forming device so as to be in serial communication with the image forming device;

wherein the image forming device comprises:

a book content data input section into which book content data regarding a content of a book is entered;

a cover sheet data input section into which cover sheet data regarding a cover sheet display is entered;

a common image formation section for both: (i) forming images on recording sheets based on the book content data entered through the book content data input section, and (ii) forming an image on a case cover based on the cover sheet data entered through the cover sheet data input section, wherein the case cover has a front cover sheet area, a spine area, and a back cover sheet area;

recording sheet housing means for housing the recording sheets;

recording sheet feeding means for feeding the recording sheets to the image formation section;

case cover housing means for housing the case cover;

case cover feeding means for feeding the case cover to the image formation section; and recording sheet thickness registration means for registering thickness data corresponding to a thickness of one recording sheet for each kind of paper;

wherein the bookbinding device comprises:

collected sheet number counting means for counting a number of the recording sheets on which the images have been formed for a book;

back-gluing means for back-gluing the recording sheets on which the images have been formed;

casing means for casing the back-glued recording sheets with the case cover to bond the back-glued recording sheets; and spine area thickness calculation means for calculating a thickness necessary for the spine area based on the thickness data registered by the recording sheet thickness registration means and data of the number of recording sheets counted by the collected sheet counting means; and wherein the image forming device further comprises:

cover sheet image formation positioning means for, when the image is formed on the case cover, positioning the image to be formed on the case cover based on the thickness necessary for the spine area, such that any extra portion of the case cover is identified.

2. The bookbinding system according to claim 1, further comprising:

recording sheet conveying means for conveying the recording sheets on which the images have been formed;

collection means for collecting the recording sheets on which the images have been formed and which have been conveyed by the recording sheet conveying means;

alignment means for aligning the recording sheets collected by the collection means before the back-gluing is performed; and case cover conveying means for conveying the case cover on which the image has been formed to the casing means.

3. The bookbinding system according to claim 1, wherein the image forming device comprises a network communication section as the book content data input section and the cover sheet data input section; and wherein at least a part of the book content data and the and said at least a part of the book content data and the cover cover sheet data is stored in a server connected to a network, sheet data is transmitted to the book content data input section and the cover sheet data input section through the network.

4. The bookbinding system according to claim 1, wherein the image formation section comprises one of a color printer, and a monochromatic printer.

5. The bookbinding system according to claim 1, wherein an image is formed in advance on the case cover before the case cover is housed in the case cover housing means, and the image formation section superposes the image of the cover sheet display on the case cover having the image formed thereon in advance.

6. The bookbinding system according to claim 5, wherein the image formed in advance on the case cover is printed in color and the superposed image is monochromatic.

7. The bookbinding system according to claim 1, wherein the cover sheet display includes at least one of a book title, an author's name, a publishing house, a price, a bookstore's name, and barcode information.

8. The bookbinding system according to claim 1, wherein the cover sheet display includes intrinsic information of a book purchaser.

9. The bookbinding system according to claim 8, wherein the intrinsic information includes at least one of an address of the book purchaser, a name, a message by the purchaser, and a purchase date.

10. The bookbinding system according to claim 1, wherein the cover sheet image formation positioning means positions the image to be formed on the case cover based on one of a center reference and a one-side abutment reference and based on the thickness necessary for the spine area.

11. The bookbinding system according to claim 1, further comprising case cover presence detection means, which is disposed in the case cover housing means, for detecting a presence of the case cover in the case cover housing means.

12. The bookbinding system according to claim 11, further comprising means for starting image formation of the book content data irrespective of a result of the presence detection by the case cover presence detection means.

13. The bookbinding system according to claim 11, further comprising:

case cover size detection means, which is disposed in the case cover housing means, for detecting a size of the case cover; and means for stopping the feeding of the case cover from the case cover housing means if one of: (i) the case cover presence detection means detects that no case cover is present in the case cover housing means, and (ii) the case cover size detection means detects a size other than a predetermined size.

14. The bookbinding system according to claim 13, further comprising means for starting the feeding of the case cover if, after the case cover presence detection means detects that no case cover is present, the case cover presence detection means detects that a case cover is present in the case cover housing means after image formation based on the book content data is started.

15. The bookbinding system according to claim 13, further comprising means for starting the feeding of the case cover if, after the case cover size detection means detects the size other than the predetermined size, the case cover size detection means detects a case cover having a size equal to the predetermined size in the case cover housing means after image formation based on the book content data is started.

16. The bookbinding system according to claim 11, further comprising case cover size detection means, which is disposed in the case cover housing means, for detecting a size of the case cover;

wherein the back-gluing is not performed by the back-gluing means if one of: (i) the case cover presence detection means detects that no case cover is present in the case cover housing means, and (ii) the case cover size detection means detects a size other than a predetermined size.

17. The bookbinding system according to claim 16, wherein the back-gluing is performed by the back-gluing means if, after the back-gluing is inhibited due to the case cover presence detection means detecting that no case cover is present, the case cover presence detection means detects that a case cover is present in the case cover housing means.

18. The bookbinding system according to claim 16, wherein the back-gluing is performed by the back-gluing means if, after the back-gluing is inhibited due to the case cover size detection means detecting the size other than the predetermined size, the case cover size detection means detects a case cover having a size equal to the predetermined size in the case cover housing means.

19. The bookbinding system according to claim 11, further comprising case cover size detection means, which is disposed in the case cover housing means, for detecting a size of the case cover;

wherein after completion of the back-gluing, the casing is not performed by the casing means if one of: (i) the case cover presence detection means detects that no case cover is present in the case cover housing means, and (ii) the case cover size detection means detects a size other than the a predetermined size.

20. The bookbinding system according to claim 19, wherein the casing is performed by the casing means if, after the casing is inhibited due to the case cover presence detection means detecting that no case cover is present, the case cover presence detection means detects that a case cover is present in the case cover housing means.

21. The bookbinding system according to claim 20, wherein, when the casing is performed after being inhibited, glue used for the back-gluing is heated to melt and then the casing operation is started.

22. The bookbinding system according to claim 19, wherein the casing is performed by the casing means if, after the casing is inhibited due to the case cover size detection means detecting the size other than the predetermined size, the case cover size detection means detects a case cover having a size equal to the predetermined size in the case cover housing means.

23. The bookbinding system according to claim 19, further comprising means for notifying a stopped state if at least one of the feeding of the case cover, the back-gluing, and the casing operation is stopped.

24. The bookbinding system according to claim 1, further comprising case cover size detection means, which is disposed in the case cover housing means, for detecting a size of the case cover in the case cover housing means.

25. The bookbinding system according to claim 24, further comprising means for starting image formation of the book content data irrespective of a result of the size detection by the case cover size detection means.

26. The bookbinding system according to claim 1, wherein the case cover housing means sequentially stacks case covers, and the case cover feeding means sequentially feeds the stacked case covers from a bottom of the case cover housing means.

27. The bookbinding system according to claim 1, wherein cover identification information is imparted to the case cover and corresponds to content identification information of the book content data;

wherein the image forming device further comprises identification information reading means for reading the cover identification information of the case cover housed in the case cover housing means; and wherein the cover identification information read by the identification information reading means is compared with the content identification information, and the case cover is fed only if it is determined that the cover identification information corresponds to the content identification information.

28. The bookbinding system according to claim 27, wherein the cover identification information is imparted to the case cover beforehand by printing or image formation.

29. The bookbinding system according to claim 27, wherein the feeding of the case cover is stopped if it is determined that the cover identification information does not correspond to the content identification information.

30. The bookbinding system according to claim 27, further comprising notification means for notifying that the cover identification information does not correspond to the content identification information.

31. The bookbinding system according to claim 27, further comprising:

a plurality of said case cover housing means, the plurality of case cover housing means being placed in order; and case cover selection means for reading the cover identification information of case covers housed in a first one of the case cover housing means in accordance with the order, comparing the read cover identification information with the content identification information, and one of: (i) targeting each of the case covers housed in the first case cover housing means to be fed if the read cover identification information is determined to correspond to the content identification information, and (ii) performing said reading and said comparing for a next one of the case cover housing means in the order if it is determined, that the read cover identification information does not correspond to the content identification information.

32. The bookbinding system according to claim 31, wherein general-purpose cover identification information is set to correspond to a plurality of content identification information, and the general-purpose cover identification information is imparted to each of the case covers in at least one of the plurality of case cover housing means; and wherein the case cover selection means targets the case covers imparted with the general-purpose identification information to be fed if there is no case cover which has cover identification information corresponding specifically to the content identification information.

33. The bookbinding system according to claim 1, wherein the case cover has a short side equal in length to a first side of the recording sheets, and a long side equal in length to a sum of twice a length of a second side of the recording sheets and the thickness necessary for the spine area.

34. The bookbinding system according to claim 1, further comprising folding means for folding inward a protruding portion of the case cover that extends farther than a sheet size of the recording sheets, if the case cover has a short side equal in length to a first side of the recording sheets, and a long side that is greater in length than a sum of twice a length of a second side of the recording sheets and the thickness necessary for the spine area.

35. The bookbinding system according to claim 1, further comprising:

imposing means for allocating the book content data to the recording sheets such that four pages of text are formed on each of the recording sheets when the images are formed on the recording sheets by the image formation section, wherein the imposing means allocates the book content data such that a 4N+1th page and a 4N+4th page of text are positioned on a first side of each recording sheet and a 4N+2th page and a 4N+3th page are positioned on a second side of each recording sheet, wherein when the recording sheets are folded, the respective first sides thereof are outer sides and the respective second sides thereof are inner sides, and wherein N is an integer that is set at 0 for a first one of the recording sheets and is increased by 1 for each subsequent recording sheet; and middle-folding means for folding each of the recording sheets at a middle of the recording sheet after the recording sheet has had the four pages of text formed thereon.

36. The bookbinding system according to claim 35, wherein the recording sheets are collected, aligned and back-glued while the recording sheets are in the middle-folded state.

37. The bookbinding system according to claim 1, wherein the bookbinding device further comprises cutting means for cutting off each extra portion of the case cover.

38. The bookbinding system according to claim 37, wherein the cutting means cuts at least one protruding portion of the case cover that extends farther than a sheet size of the recording sheets, if the case cover has a short side equal in length to a first side of the recording sheets, and a long side that is greater in length than a sum of twice a length of a second side of the recording sheets and the thickness necessary for the spine area.

39. The bookbinding system according to claim 37, wherein the cutting means cuts on three protruding sides of the case cover that extend farther than a sheet size of the recording sheets, if the case cover has a short side that is greater in length than a first side of the recording sheets, and a long side that is greater in length than a sum of twice a length of a second side of the recording sheets and the thickness necessary for the spine area.

* * * * *